US005368996A

United States Patent [19]

Asami

[11] Patent Number: 5,368,996

[45] Date of Patent: Nov. 29, 1994

[54] COLOR PHOTOGRAPHIC MATERIAL

[75] Inventor: Masahiro Asami, Kanagawa, Japan

[73] Assignee: Fuji Photo Film Co., Ltd., Kanagawa, Japan

[21] Appl. No.: 84,998

[22] Filed: Jul. 2, 1993

[30] Foreign Application Priority Data

Jul. 6, 1992 [JP] Japan ..... 4-200206

[51] Int. Cl.[5] ..... G03C 1/76

[52] U.S. Cl. ..... 430/531; 430/523; 430/538; 430/536; 430/539; 430/950; 430/558

[58] Field of Search ..... 430/523, 538, 531, 536, 430/539, 950, 558

[56] References Cited

U.S. PATENT DOCUMENTS

| | | | |
|---|---|---|---|
| 4,584,266 | 4/1986 | Hirose et al. | 430/555 |
| 4,755,454 | 7/1988 | Aotsuka et al. | 430/538 |
| 5,057,405 | 10/1991 | Shiba et al. | 430/363 |
| 5,077,179 | 12/1991 | Abe et al. | 430/372 |
| 5,198,328 | 3/1993 | Shiba et al. | 430/363 |

FOREIGN PATENT DOCUMENTS

| | | |
|---|---|---|
| 0337490 | 4/1989 | European Pat. Off. . |
| 0388908 | 9/1990 | European Pat. Off. . |
| 467033 | 6/1991 | Japan . |

OTHER PUBLICATIONS

Patent Abstracts of Japan vol. 14, No. 15 (P-989) (3958) 12 Jan. 1980 and JP-A-12 62 538 (Mitsubishi) 19 Oct. 1989.

*Primary Examiner*—Charles L. Bowers, Jr.
*Assistant Examiner*—Thomas R. Neville
*Attorney, Agent, or Firm*—Sughrue, Mion, Zinn, Macpeak & Seas

[57] ABSTRACT

A color photographic material having photographic constituent layers including at least one light-sensitive silver halide emulsion layer on a reflective support, wherein the light-sensitive silver halide emulsion layer comprises silver chloride or silver chlorobromide containing 90 mol % or more of silver chloride is disclosed. The reflective support comprises at least one water-resistant resin layer, the water-resistant resin layer on the side of the support on which a silver halide emulsion layer is formed contains 14% by weight or more of a white pigment, and the total amount of calcium contained in the photographic constituent layers on the light-sensitive layer side of the photographic material is 10 mg/m$^2$ or less, or the photographic material comprises at least one hydrophilic colloid layer on the support, the hydrophilic colloidal layer contains a white pigment at a coating amount of 2 g/m$^2$ or more, and the total amount of calcium contained in photographic constituent layers on the light-sensitive layer side of the photographic material is 10 mg/m$^2$ or less.

15 Claims, No Drawings

COLOR PHOTOGRAPHIC MATERIAL

FIELD OF THE INVENTION

The present invention relates to a color photographic material, and more particularly to a color photographic material which does not tend to fog when pressure is applied to the material or the material is bent; which has excellent handling characteristics; and which can provide extremely sharp color prints.

BACKGROUND OF THE INVENTION

Color photographs widely prevailing today are making progress increasingly rapidly to a degree that they are readily available at virtually any location due to improvements in the photographic materials themselves and in processing techniques. In color photographic paper for preparing color prints for viewing, particularly, impartation of water resistance to paper supports by coating both sides of each support with a resin and practical applications of photographic materials using high silver chloride emulsions having a high silver chloride content as disclosed in PCT International Publication No. WO87/04534 and processing methods thereof bring about rapid high-level processing.

Parallel to pursuance of such rapid processing, techniques for enhancing the quality of print images to be obtained have also been developed. The image quality of color prints now commercially produced has always been improved with the times. However, the required quality is getting higher.

The quality of color images is determined by many kinds of properties such as gradation reproducibility, color reproducibility, granularity and sharpness. Of these, the sharpness is an important property controlling the depiction of details and three-dimensional appearance of images obtained, and an improvement thereof has been earnestly desired.

In the recent development of color print material techniques, however, an improvement in sharpness is not necessarily sufficient. This is largely caused by the performance of paper supports coated with polyolefin resins which are introduced particularly to obtain easy, rapid processing. Namely, a problem has been encountered in that color images on photographic paper using the water-resistant resin-coated paper as a support are inferior in sharpness to those on photographic paper using the baryta paper which has previously been used as a support for photographic paper. The cause of this problem has been considered to be a small amount of white pigment kneaded in the water-resistant resin layer covering the side of the support on which a light-sensitive emulsion layer is formed, which results in scattering and diffusion of light into the resin layer on exposure to deteriorate the images.

Many attempts have been made to overcome this disadvantage of water-resistant resin-coated paper supports.

Techniques for enhancing the content of white pigments dispersed in polyolefin resins are disclosed, for example, in JP-A-51-6531 (the term "JP-A" as used herein means an "unexamined published Japanese patent application"), JP-A-52-35625, JP-A-55-108658, JP-A-55-113039, JP-A-57-151942, JP-A-3-156439 and JP-A-3-156452. Although these techniques tend to improve sharpness, the improvement is insufficient. Further, it has been revealed that a photographic material comprising a support containing a white pigment in an increased content and a high silver chloride emulsion advantageous for rapid processing applied thereto has the disadvantage of fogging at places where pressure have been applied to the material or at places where the material has been bent.

As techniques for increasing the content of white pigments, JP-A-57-27257 and JP-A-57-49946 disclose methods of coating supports with mixtures of pigments and compositions hardenable with electron beams, followed by irradiation with electron beams to form water-resistant resin layers. However, even the use of these technique was found to promote the above-described problem encountered when the high silver chloride emulsions advantageous for rapid processing are used.

As other means, JP-B-57-53937 (the term "JP-B" as used herein means an "examined Japanese patent publication"), JP-A-50-44818, JP-A-57-64235 and JP-A-59-177542 disclose methods of providing hydrophilic colloidal layers containing white pigments between polyolefin-coated paper supports and light-sensitive silver halide emulsion layers. The use of these means can further increase the content of the pigments in the hydrophilic colloidal layers to improve sharpness. In photographic materials in which these techniques and silver chloride emulsions advantageous for rapid processing were combined with each other, the above-described problem of fogging at pressure-applied or bent places was found to become increasingly significant.

As still other means, JP-A-3-113443 and JP-A-4-67033 disclose methods of providing coloring layers containing solid dispersions of colloidal silver or dyes discolorable with processing between reflective supports and light-sensitive emulsion layers. These means are effective to overcome the above-described disadvantage of the supports. However, it has been found that the problem of fogging at pressure-applied or bent places upon use of the high silver chloride emulsions is not solved yet, and often tends to become more serious.

Accordingly, when the water-resistant resin-coated paper supports advantageous for rapid, easy processing are used in combination with the light-sensitive emulsion layers containing high silver chloride emulsions to form color photographic paper, a technique is needed for enhancing sharpness while solving the handling problems such as development of fogging caused by pressure.

SUMMARY OF THE INVENTION

As is apparent from the above description, an object of the present invention is to provide a color photographic material, particularly a color photographic paper, with excellent image sharpness, and with rapid processing ability, and more particularly to provide a silver halide color photographic material which has increased white pigment content in a water-resistant resin layer on the side of a support on which a light-sensitive emulsion layer is formed or which has a white pigment-containing hydrophilic colloidal layer provided between the support and the light-sensitive emulsion layer to improve sharpness, and with excellent sharpness and little fogging development on application of pressure thereon or on bending, exhibiting excellent handling ability.

The above-described object of the present invention is attained by (1) a color photographic material having photographic constituent layers including at least one light-sensitive silver halide emulsion layer on a reflective support, wherein the light-sensitive silver halide emulsion layer comprises silver chloride or silver chlorobromide containing 90 mol % or more of silver chloride, the reflective support comprises at least one water-resistant resin layer, the water-resistant resin layer on the side on which a silver halide emulsion layer is formed contains 14% by weight or more of a white pigment, and the total amount of calcium contained in the photographic constituent layers on the light-sensitive layer side of the photographic material is 10 mg/m$^2$ or less;

(2) a color photographic material having photographic constituent layers including at least one light-sensitive silver halide emulsion layer and hydrophilic colloidal layers on a support, wherein the light-sensitive silver halide emulsion layer comprises silver chloride or silver chlorobromide containing 90 mol % or more of silver chloride, at least one of the hydrophilic colloidal layers contains a white pigment at a coating amount of 2 g/m$^2$ or more, and the total amount of calcium contained in the photographic constituent layers on the light-sensitive layer side of the photographic material is 10 mg/m$^2$ or less;

(3) the color photographic material described in (1) or (2), which comprises a coloring layer located at any position in the group of hydrophilic colloidal layers formed on the light-sensitive layer side of the support and which is discolorable with processing; and (4) the color photographic material described in (1), wherein the water-resistant resin layer contains 15% by weight or more of the white pigment.

DETAILED DESCRIPTION OF THE INVENTION

It is a novel finding which can not be anticipated from previously known information that reduction in the total amount of calcium contained in the photographic constituent layers to 10 mg/m$^2$ or less reduces fogging at places where pressure is applied to the material or at places where the material has been bent, wherein the material has a support laminated with a water-resistant resin layer containing an increased amount of the white pigment or a support coated with a white pigment-containing hydrophilic colloidal layer and has a high silver chloride emulsion layer coated on the support.

In one embodiment of the present invention, it is necessary to use a support in which the density of the white pigment contained in the water-resistant resin layer covering the side of a paper substrate on which the silver halide emulsion layer is formed is increased to 14% by weight or more, preferably 15% by weight or more. There is no particular upper restriction on the density, but the density is preferably 90% by weight or less to form a uniform film.

The white pigments usable in the present invention include titanium dioxide, barium sulfate, lithopone, alumina white, calcium carbonate, silica white, antimony trioxide, titanium phosphate, zinc oxide, white lead and gypsum. Of these pigments, titanium dioxide is particularly effectively used. Either rutile-type titanium oxide or anatase-type titanium oxide may be used, and it may be produced by any of the sulfate method and the chloride method.

Finely divided pigments such as titanium dioxide are preferably surface treated with dihydric to tetrahydric alcohols such as 2,4-dihydroxy-2-methylpentane and trimethylolethane as described in JP-A-58-17151 for use, in combination with inorganic oxides such as silica and aluminum oxide. In such a case, the weight of the white pigments is calculated using values containing the weight of these surface-treating substances.

The water-resistant resin layer containing the finely divided white pigment such as titanium dioxide is used in a thickness of 3 to 200 μm, preferably 5 to 80 μm.

The water-resistant resin layer containing the finely divided white pigment such as titanium dioxide used in the present invention may be laminated with a plurality of water-resistant resin layers, for example, different in the content of the white pigment, different in the kind of white pigment or containing no white pigment. In such a case, the water-resistant resin layer containing the finely divided white pigment such as titanium dioxide used in the present invention is preferably arranged apart from, i.e., not adjacent to, the support.

In the present invention, the coefficient of variation of the occupied area ratio (%) of the finely divided pigments is preferably 0.20 or less, more preferably 0.15 or less and most preferably 0.10 or less.

The dispersibility of the finely divided white pigments such as titanium dioxide in the water-resistant resin layers can be evaluated from the occupied area ratio (%) obtained by allowing the surface resins having a thickness of about 0.1 μm, preferably about 0.05 μm, to scatter by the ion sputtering method using glow discharge and observing fine grains of the pigments exposed with an electron microscope, and the coefficient of variation thereof. The ion sputtering method is described in Y. Murayama and K. Kashiwagi, "Surface Treating Techniques Utilizing Plasma", *Kikai no Kenkyu* (*Studies of Machinery*), 33, No. 6 (1981) in detail.

In order to control the coefficient of variation of the occupied area ratio of the grains of the white pigments to 0.20 or less, the white pigments are preferably mixed sufficiently in the presence of surfactants, and the finely divided pigments surface treated with the dihydric to tetrahydric alcohols as described above are preferably used.

Most typically, the occupied area ratio (%) of fine grains of a white pigment per specified unit area can be determined by dividing an observed area into 6 μm×6 μm unit areas adjacent to one another and measuring the occupied area ratio (%) (Ri) of the fine grains projected to the unit areas. The coefficient of variation of the occupied area ratio (%) can be determined by the ratio s/Rm of the standard deviation s of Ri to the mean value Rm of Ri. The number (n) of the unit areas to be measured is preferably 6 or more.

Substrates for the above-described water-resistant resin-coated supports used in the present invention include base paper obtained from natural pulp, synthetic pulp or mixtures thereof; films of polyesters such as polyethylene terephthalate and polybutylene terephthalate; and plastic films formed of cellulose triacetate, polystyrene or polyolefins.

The above-described base paper used in the present invention is selected from materials generally used for photographic paper. Namely, paper mainly comprising natural pulp obtained from conifers, broadleaf trees or the like is used, to which fillers such as clay, talc, calcium carbonate and urea resins; sizing agents such as rosin, alkylketene dimers, higher fatty acids, paraffin wax and alkenylsuccinic acids; paper strength enhancers such as polyacrylamide; and fixing agents such as aluminum sulfate and cationic polymers may be added as so desired. In particular, neutral paper having a pH of 5 or more in which reactive sizing agents such as alkylketene dimers and alkenylsuccinic acids are used is preferably employed. It can be judged by measurement with a pH meter using a plane GST-5313F manufactured by Toa Denpa Kogyo as an electrode whether or not the base paper used for the substrates of the supports in the present invention is neutral. The neutral paper has a pH of 5 or more, and preferably a pH of 5 to 9.

Further, synthetic pulp may be used instead of the above-described natural pulp, and mixtures of the natural pulp and the synthetic pulp at any ratio may also be used. The surface of this pulp can also be size treated with film-forming polymers such as gelatin, starch, carboxymethyl cellulose, polyacrylamide, and modified products of polyvinyl alcohol. In this case, the modified products of polyvinyl alcohol include carboxyl group-modified products, silanol-modified products and copolymers with polyacrylamide.

When the surface of the pulp is size treated with the film-forming polymers, the amount of the film-forming polymers applied is adjusted to 0.1 to 5.0 g/m$^2$, and preferably to 0.5 to 2.0 g/m$^2$. In this case, antistatic agents, fluorescent brightening agents, pigments and defoaming agents can be added to the film-forming polymers as so desired.

The base paper is produced by making paper from a pulp slurry containing the above-described pulp and additives such as the fillers, the sizing agents, the paper strength enhancers and the fixing agents as so desired, through a paper machine such as a wire paper machine, followed by drying and winding. The above-described surface size treatment is carried out either before or after this drying, and calender treatment is performed between the drying and the winding. When the surface size treatment is performed after the drying, this calender treatment can be carried out either before or after the surface size treatment.

In the present invention, the water-resistant resin layers themselves may constitute the supports, such as vinyl chloride resins.

The water-resistant resin layers used in the present invention have a water absorption (% by weight) at 25° C. of 0.5 or less, preferably 0.1 or less. Examples of suitable resins for such layers include polyalkylenes such as polyethylene, polypropylene and copolymers thereof, polystyrene, polyacrylates, other vinyl polymers, polyesters and copolymers thereof. The polyalkylene resins such as low-density polyethylene, high-density polyethylene, polypropylene and blended polymers thereof are preferably used. Fluorescent brightening agents, antioxidants, antistatic agents and releasing agents are added to the water-resistant resin layers as so desired.

For example, unsaturated organic compounds containing one or more carbon-carbon double bonds in one molecule as described in JP-A-57-27257, JP-A-57-49946 and JP-A-61-262738, such as methacrylate compounds, or tri- or tetra-acrylates represented by the general formula in JP-A-61-262738 can be used. In these cases, titanium dioxide or other white pigments are dispersed in the unsaturated organic compounds, and applied to the substrates, followed by irradiation with electron beams to harden the compounds, whereby white pigment-containing water-resistant resin layers can be formed. To these resin layers, other resins may be mixed.

Methods for forming the water-resistant resin layers which can be used in the present invention include lamination methods such as a dry lamination method and a non-solvent dry lamination method as described in *New Laminate Processing Handbook*, edited by Kako Gijutsu Kenkyu-Kai. Methods for coating which are used in the present invention are selected from gravure roll type methods, wire bar type methods, doctor blade type methods, reverse roll type methods, dip type methods, air knife type methods, calender type methods, kiss type methods, squeeze type methods, fountain type methods and coating type methods.

The supports are preferably subjected to corona discharge, glow discharge or flame treatment, and the hydrophilic colloidal layers of the silver halide photographic materials are formed thereon.

The basis weight of the supports is preferably 30 to 350 g/m$^2$, and more preferably 50 to 200 g/m$^2$.

In another embodiment of the present invention, when the hydrophilic colloidal layers containing the white pigments are formed on the supports, it is necessary to adjust the coating amount of the white pigments to 2 g/m$^2$ or more, preferably to 4 g/m$^2$ or more, more preferably to 8 g/m$^2$ or more. There is no particular upper restriction on the coating amount of the white pigments, but it is preferably 40 g/m$^2$ or less.

When the white pigments contain various surface treating agents or dispersion stabilizing agents for the purpose of improving the dispersibility thereof in the present invention, the weight of the white pigments is taken as the value containing the weight of such agents.

Although the ratio of the white pigment contained in the hydrophilic colloidal layer to a hydrophilic binder can be optionally established, the suitable amount of the white pigment is 10% by weight or more, preferably 20% by weight or more, more preferably 40% by weight or more, and most preferably 70% by weight or more. There is no particular upper restriction thereon, but it is preferably 99% by weight or less.

The thickness of the hydrophilic colloidal layer containing the white pigment depends on the above-described content and the amount applied. However, it is preferably within the range of 0.5 to 10 μm.

The white pigments usable in the present invention include titanium dioxide, barium sulfate, lithopone, alumina white, calcium carbonate, silica white, antimony trioxide, titanium phosphate, zinc oxide, white lead and gypsum. Of these pigments, titanium dioxide is particularly effectively used. Either rutile-type titanium oxide or anatase-type titanium oxide may be used, and it may be produced by any of the sulfate method and the chloride method. The grains of the white pigment used in the hydrophilic colloidal layer have a mean grain size of 0.1 to 1.0 μm, preferably 0.2 to 0.3 μm.

In the present invention, as binders constituting the hydrophilic colloidal layers containing the white pigments, the silver halide emulsion layers and light-insensitive intermediate layers, gelatin can be preferably used. Other hydrophilic colloids can also be used in place of gelatin at any ratio as so desired.

Examples of such colloids include proteins such as gelatin derivatives, graft copolymers of gelatin and other polymers, albumin and casein; cellulose derivatives such as hydroxyethyl cellulose, carboxymethyl cellulose and cellulose sulfate esters; saccharides such as sodium alginate and starch derivatives; and a wide variety of synthetic polymers such as polyvinyl alcohol, partially acetalized polyvinyl alcohol, poly(N-vinylpyrrolidone), polyacrylic acid, polymethacrylic acid, polyacrylamide, polyvinylimidazole and polyvinylpyrazole.

In the present invention, various additives used in photographic materials other than the white pigments and the binders can be added to the white pigment-containing hydrophilic colloidal layers. For example, they are surfactants as coating aids, hardeners, dyes or antifoggants. Further, a high boiling organic solvent dispersed in fine oil drop form may be added. When a dispersion of a high boiling organic solvent is added, various oil-soluble materials such as fluorescent brightening agents are preferably dissolved therein for addition.

A preferred photographic material of the present invention comprises a support having provided thereon at least one light-sensitive emulsion layer, a light-insensitive layers such as a color mixing preventing layer and a protective layer, and a hydrophilic colloidal layer containing the white pigment.

In the present invention, a hydrophilic colloidal layer containing a white pigment is formed between the support and a light-sensitive emulsion layer.

Suitable supports for carrying the hydrophilic colloidal layers containing the white pigments include paper formed of natural pulp or synthetic pulp, baryta paper, paper coated with resins such as polyolefins (e.g., polyethylene, polypropylene) and polyesters, films formed of synthetic polymers such as polyethylene, polypropylene, polystyrene, polycarbonates, hard polyvinyl chloride and polyethylene terephthalate, and films formed of natural polymers such as cellulose diacetate, cellulose triacetate and nitrocellulose. From the viewpoint of rapid processing of the photographic materials, it is preferred that the supports have water resistance. Namely, a water-resistant resin-coated paper or the polymer films are preferably used. A support having a surface of the second diffuse reflectance may also be used. The term "second diffuse reflectance" means diffuse reflectance obtained by giving irregularities to a mirror surface to divide it into fine mirror surfaces facing to different directions, thereby dispersing the directions of the finely divided surfaces (mirror surfaces). The irregularities of the surface having the second diffuse reflectance have a mean three-dimensional roughness of 0.1 to 2 μm, preferably 0.1 to 1.2 μm. The frequency of the surface irregularities is preferably 0.1 to 2000 cycles/mm, and more preferably 50 to 600 cycles/mm, for the irregularities having a roughness of 0.1 μm or more. The details of such a support are described in JP-A-2-239244.

In the present invention, an embodiment may be used in which only the hydrophilic colloidal layer contains the white pigment, and a resin constituting the support such as a resin covering the paper substrate and a resin film or the support itself contain no white pigment. Further, an embodiment may also be used in which the above-described resin constituting the support also contains the white pigment, in addition to the hydrophilic colloidal layer containing the white pigment.

A light-sensitive emulsion layer may be provided directly on the hydrophilic colloidal layer containing the white pigment, or on one or more light-insensitive hydrophilic colloidal layers provided on the hydrophilic colloidal layer containing the white pigment. When the one or more light-insensitive hydrophilic colloidal layers are provided, the total thickness thereof is preferably 5 μm or less, and more preferably 2 μm or less. These light-insensitive hydrophilic colloidal layers can contain various photographic useful materials, for example, surfactants as coating aids, hardeners, dyes or antifoggants. Further, colloidal silver, a dye dispersed in solid form or a dye adsorbed by a cationic polymer can be added to form a coloring layer discolorable on processing. A high boiling organic solvent dispersed in fine oil drop form can also be added. Photographic useful materials such as oil-soluble color mixing inhibitors, fluorescent brightening agents and ultraviolet absorbers can be dissolved therein for addition.

In the present invention, the sharpness can be further improved by providing a coloring layer discolorable with processing at any position among the group of hydrophilic colloidal layers formed on the light-sensitive layer side of the support, in addition to the above-described application techniques of the white pigments.

Previously, the use of a coloring layer has resulted in the adverse effect of increasing fogging developed when pressure is applied to the photographic material or the photographic material is bent. However, this problem can be solved by reducing the total amount of calcium contained in the photographic constituent layers to 10 mg/m$^2$ or less.

The coloring layer discolorable with processing which may be used in the present invention may be in direct contact with an emulsion layer, or may be situated on an intermediate layer containing a color mixing inhibitor such as gelatin or hydroquinone. The coloring layer is preferably provided under an emulsion layer (that is, on the support side of an emulsion layer) having sensitivity in a region roughly overlapping the light wavelength region absorbed by the coloring material in the coloring layer. Coloring layers may be provided corresponding to all emulsion layers sensitized so as to have sensitivity in different wavelength regions, respectively, and only some can also be selected from them and provided. Further, it is also possible to provide a coloring layer having absorption in a wide wavelength region so as to correspond to a plurality of emulsion layers different in sensitizing wavelength.

With respect to the optical reflective density of the coloring layers, the optical density value in the wavelength exhibiting the highest density in the visible light region having a light wavelength of 400 to 700 nm is preferably 0.2 to 3.0, more preferably 0.5 to 2.5, and most preferably 0.8 to 2.0. Known methods can be applied to form the coloring layers. Examples thereof include a method of dispersing fine powders of dyes in solid form, a method of mordanting anionic dyes to cationic polymers, a method of allowing dyes to be adsorbed by fine grains such as silver halide to fix the dyes in the layers, and a method of using colloidal silver. As the method of dispersing fine powders of dyes in solid form, a method is described in JP-A-2-308244, pages 4 to 13, in which for example, finely divided dyes which are substantially insoluble in water at pH 6 or less, but substantially soluble in water at pH 8 or more are added. Further, for example, a method is described in JP-A-2-84637, pages 18 to 26, in which anionic dyes are mordanted to cationic polymers. Methods for preparing colloidal silver as a light absorber are described in U.S. Pat. Nos. 2,688,601 and 3,459,563. Of these methods, the method of adding finely divided dyes and the method of using colloidal silver are preferably used.

In the present invention, it is essential that the amount of calcium contained in the photographic material be 10 mg/m$^2$ or less. The content of calcium is represented by the weight, converting calcium ions and atoms or calcium-containing compounds contained in 1 m$^2$ of the photographic material to a calcium atom basis. Known analysis methods are used to determine the calcium content. For example, the ICP analysis method can be used which is described in detail in *Kagaku no Ryoiki* (*Region of Chemistry*), extra edition No. 127, Nankodo (1980) and V. A. Fassel, *Anal. Chem.*, 46, 1110A (1974).

Calcium contained in the photographic material is introduced as an impurity in gelatin usually employed as the binder. Gelatin contains calcium salts derived from starting materials and manufacturing processes in an amount of several thousand ppm, converted to a calcium atom basis. When the photographic material is prepared using such gelatin, calcium is contained in an amount close to 20 mg/m$^2$, for example, in the case of a photographic material for color photographic paper.

In the present invention, a reduction in calcium content to 10 mg/m$^2$ or less effectively decreases development of fogging caused by pressure of the high silver chloride emulsion which is generated when the content of the white pigment contained in the water-resistant resin covering the emulsion layer side of the support is increased or the hydrophilic colloidal layer containing the white pigment is provided on the support. The calcium content is preferably 8 mg/m$^2$ or less, more preferably 5 mg/m$^2$ or less and most preferably 2 mg/m$^2$ or less (including 0 mg/m$^2$).

There have hitherto been some reports about techniques specifying the calcium content in photographic materials. Such reports are described in JP-A-60-159850, JP-A-1-303438 and JP-A-4-67033. However, these techniques are techniques for reducing variation in photographic properties on continuous processing of photographic materials, techniques for improving keeping quality after processing, or techniques for improving residual color stain when dispersed solid dyes are used. These known literatures are silent on the fact that the calcium content affects fogging caused by pressure generated when a light-sensitive material comprising an emulsion layer using a high silver chloride emulsion is formed on a support having an increased content of a white pigment for improving sharpness or having a hydrophilic colloidal layer containing a white pigment provided on the support. The effect of the present invention is an unexpected discovery.

In order to reduce the content of calcium in the photographic material, gelatin decreased in calcium content can be used as the binder, or methods can be used in which silver halide emulsions, gelatin dispersion compositions such as coupler dispersions or mixtures thereof used in the preparation of the photographic material are treated by water washing with noodle, dialysis or ultrafiltration to remove calcium. In the present invention, it is preferred to use gelatin reduced in calcium content. In place of gelatin, calcium-free binders can be used.

In order to reduce the content of calcium in gelatin, generally ion exchange treatment is preferably employed. The ion exchange treatment can be carried out by bringing gelatin solutions into contact with ion exchange resins, particularly cation exchange resins, in preparing or using gelatin, for example, as described in JP-A-63-296035.

In addition, gelatin reduced in calcium content includes acid-treated gelatin contaminated with a minimal amount of calcium on preparation.

In the present invention, lime-treated gelatin subjected to an ion exchange treatment is preferably used in the preparation of emulsified dispersions of couplers, silver halide emulsions, and coating solutions for light-insensitive layers such as an intermediate layer.

The color photographic material of the present invention can be formed by applying at least one layer for each of yellow, magenta and cyan color developing silver halide emulsion layers on a reflective support. For ordinary photographic paper, a color coupler forming a dye complementary to light to which the emulsion layer is sensitive is allowed to be contained, thereby color reproduction can be achieved according to a subtractive color process. For ordinary photographic paper, grains of the silver halide emulsions are spectrally sensitized with blue-sensitive, green-sensitive and red-sensitive spectrally sensitizing dyes, respectively, in the order of color developing layers described above, and applied on the support in the order described above. However, they may be applied in a different order. Namely, in some cases, it is preferred from the viewpoint of rapid processing that the light-sensitive layer containing silver halide grains largest in mean grain size is arranged as the uppermost layer, and in some cases, it is preferred from the viewpoint of keeping quality under light irradiation that the lowermost layer be formed as the magenta color developing light-sensitive layer.

The light-sensitive emulsion layers and the formed colors may be combined so as not to have the correspondence described above, and at least one infrared-sensitive silver halide emulsion layer may be used.

The silver halide grains of at least one layer (preferably all layers) of the silver halide emulsion layers used in the present invention are formed of silver chloride or silver chlorobromide containing 90 mol % or more of silver chloride. The content of silver chloride is preferably 95 mol % or more, and more preferably 98 mol % or more.

In the present invention, it is preferred that the silver chlorobromide or silver chloride be substantially free from silver iodide, in order to shorten the processing time. Here, "substantially free from silver iodide" means that the content of silver iodide is 1 mol % or less, and preferably 0.2 mol % or less. On the other hand, for the purpose of enhancing high illuminance sensitivity, enhancing spectral sensitization sensitivity or enhancing storage stability of a photographic material, in some cases, high silver chloride grains containing 0.01 to 3 mol % of silver iodide are preferably used for an emulsion surface as described in JP-A-3-84545.

Grains contained in the emulsion may be the same or different from one another in halogen composition. However, the use of an emulsion containing grains each of which has the same halogen composition easily homogenizes the properties of each grain.

With respect to the internal halogen composition distribution of the silver halide grains, a suitable selection can be made to use grains of a so-called uniform type structure in which the composition is the same at any portion of the grain, grains of a so-called laminated type structure in which the internal core of the grain is different from the shell (one layer or a plurality of layers) surrounding it in halogen composition, or grains of a structure in which the inside of the grain or the surface thereof has non-layer portions different in halogen composition (a structure in which the portions different in halogen composition are connected to the edges, the corners or the surface of the grain when they are on the surface of the grain). In order to obtain high sensitivity, it is more advantageous to use either of the latter two grains than to use the grains of the uniform type structure. The latter two grains are preferable also in respect to pressure resistance. When the silver halide grains have a structure as described above, a boundary between portions different from each other in halogen composition may be clear or unclear due to formation of mixed crystals by the difference in composition. Further, continuous changes in structure may have definite three layered structure.

In the high silver chloride emulsions used in the present invention, grains of a structure in which the inside and/or the surface of the silver halide grain has silver bromide-localized phases in layer form or in non-layer form are preferred. The halogen composition of the above-described localized phases is preferably at least 10 mol % in silver bromide content, and more preferably 20 to 100 mol %.

The content of silver bromide in the silver bromide-localized phases can be analyzed by an X-ray diffraction method (for example, as described in *Shin Jikken Kagaku Koza* (*New Experimental Chemistry Course*) 6, *Structural Analysis,* edited by The Chemical Society of Japan, Maruzen). These localized phases can exist inside the grain, on edges or corners on a surface of the grain, or on the surface. As one preferred example, there can be mentioned localized phases formed on the corner portions of the grain by epitaxial growth.

Further, for the purpose of reducing the quantity of replenisher of a developing solution, it is also effective to increase the silver chloride content of the silver halide emulsions. In such a case, emulsions containing nearly pure silver chloride such that the silver chloride content is 98 to 100 mol % are also preferably used. It is preferred that the silver halide grains contained in the silver halide emulsions used in the present invention have a mean grain size of 0.1 to 2 μm. The mean grain size is a number mean value of grain sizes represented by the diameters of circles equivalent to the projected areas of the grains.

Further, it is preferred that these emulsions are so-called monodisperse emulsions having a narrow grain size distribution, namely, a coefficient of variation (the standard deviation of the grain size distribution divided by the mean grain size) of not more than 20%, desirably not more than 15%, more preferably not more than 10%. At this time, for the purpose of obtaining a wide latitude, it is preferred that the above-described monodisperse emulsions be blended in the same layer or be coated in multiple layers.

The silver halide grains contained in the photographic emulsions may have a regular crystal form such as a cubic, an octahedral or a tetradecahedral form, an irregular crystal form such as a spherical or a tabular form, or a composite form thereof. Further, a mixture of grains having various crystal forms may also be used. In the present invention, it is desirable that the emulsions contain at least 50% (by number of grains), preferably at least 70%, more preferably at least 90% of the above-described grains having a regular crystal form.

Other than these, an emulsion can also be preferably used in which more than 50% (by number of grains) of all grains as a projected area are composed of tabular grains having a mean aspect ratio (diameter calculated as circle/thickness) of at least 5, preferably at least 8.

The silver chlorobromide emulsions or the silver chloride emulsions used in the present invention can be prepared according to the methods described in P. Glafkides, *Chimie et Phisique Photographique* (Paul Montel, 1967), G. F. Duffin, *Photographic Emulsion Chemistry* (Focal Press, 1966) and V. L. Zelikman et al., *Making and Coating Photographic Emulsion* (Focal Press, 1964). Namely, any of an acid process, a neutral process and an ammonia process may be used. A soluble silver salt and a soluble halogen salt may be reacted with each other by using any of a single jet process, a double jet process and a combination thereof. A so-called reverse mixing process in which grains are formed in the presence of excess silver ions can also be used. As a type of double jet process, a process for maintaining the pAg in a liquid phase constant in which a silver halide is formed, namely a so-called controlled double jet process, can also be used. According to this process, a silver halide emulsion having a regular crystal form and an approximately uniform grain size can be obtained.

The localized phases of the silver halide grains used in the present invention or a substrate, i.e., a host portion of the grains having a localized phase preferably contain different types of metal ions or complex ions thereof. Preferred metal ions are selected from the metal ions belonging to the VIII and IIb groups in the periodic table, metal complexes thereof, lead ions and thallium ions. Ions selected from iridium, rhodium, iron, etc. or complex ions thereof can be mainly used for the localized phases, and metal ions selected from osmium, iridium, rhodium, platinum, ruthenium, palladium, cobalt, nickel, iron, etc., or complex ions thereof can be mainly used in combination for the substrate. Further, the metal ions can be used changing the kind and the concentration thereof depending on the localized phases or the substrate. These metals may be used alone or in combination. In particular, iron and iridium compounds are preferably allowed to exist in the silver bromide-localized phases.

Compounds providing these metal ions are dissolved in aqueous solutions of gelatin, aqueous solutions of halide, aqueous solutions of silver salts or other aqueous solutions acting as dispersion media on the preparation of the silver halide grains, or silver halide grains previously containing the metal ions are added to dissolve the grains, thereby allowing the metal ions to be contained in the localized phases and/or other portions (substrates) of the silver halide grains used in the present invention.

The metal ions used in the present invention can be added to the emulsion grains at any stage before grain formation, during grain formation or immediately after grain formation. This can be changed depending on the positions in which the metal ions are allowed to be contained.

The silver halide emulsions used in the present invention are generally subjected to chemical sensitization and spectral sensitization.

With respect to chemical sensitization, chemical sensitization using chalcogen sensitizing agents (specific examples thereof include sulfur sensitization represented by addition of unstable sulfur compounds, selenium sensitization with selenium compounds and tellurium sensitization with tellurium compounds), noble metal sensitization represented by gold sensitization, and reduction sensitization can be used alone or in combination. The compounds described on page 18, lower right column over to page 22, upper right column of JP-A-62-215272 are preferably used for chemical sensitization.

The emulsions used in the present invention are so-called surface latent image type emulsions in which latent images are mainly formed on the surfaces of grains.

For the purpose of preventing fogging during manufacturing stages, storage or photographic processing of the light-sensitive materials or stabilizing photographic properties thereof, various compounds or their precursors may be added to the silver halide emulsions used in the present invention. Specific examples of these compounds which are preferably used are described on pages 39 to 72 of JP-A-62-215272 described above. Further, 5-arylamino-1,2,3,4-thiatriazole compounds (the aryl residue has at least one electron attractive group) as described in EP-0447647 are also preferably used.

Spectral sensitization is preferably carried out for the purpose of giving spectral sensitivity in a desired light wavelength range to an emulsion of each layer of the light-sensitive material of the present invention.

In the photographic materials of present invention, spectrally sensitizing dyes used for spectral sensitization of blue, green and red regions include, for example, dyes as described in F. M. Harmer, *Heterocyclic Compounds*-Cyanine Dyes and Related Compounds, John Wiley & Sons, New York and London (1964). Specific examples of the compounds and spectrally sensitizing methods which are preferably used are described on page 22, upper right column to page 38 of JP-A-62-215272. As red-sensitive spectrally sensitizing dyes for silver halide emulsion grains having a high silver chloride content, spectrally .sensitizing dyes as described in JP-A-3-123340 are particularly preferred from the viewpoints of stability, strength of adsorption and temperature dependency of exposure.

When an infrared region is effectively spectrally sensitized in the photographic materials of the present invention, spectrally sensitizing dyes as described on page 12, upper left column to page 21, lower left column of JP-A-3-15049; page 4, lower left column to page 15, lower left column of JP-A-3-20730; page 4, line 21 to page 6, line 54 of EP-0,420,011; page 4, line 12 to page 10, line 33 of EP-0,420,012; EP-0,443,466; and U.S. Pat. No. 4,975,362 are preferably used.

When these spectrally sensitizing dyes are allowed to be contained in the silver halide emulsions, they may be directly dispersed in the emulsions, or may be dissolved in solvents such as water, methanol, ethanol, propanol, methyl cellosolve and 2,2,3,3-tetrafluoropropanol, followed by addition to the emulsions. The solvents may be used alone or in combination. Further, they may be added to the emulsions as aqueous solutions containing bases or acids together as described in JP-B-44-23389, JP-B-44-27555 and JP-B-57-22089, or as aqueous solutions or colloidal dispersions containing surfactants together as described in U.S. Pat. Nos. 3,822,135 and 4,006,025. The dyes may also be dissolved in solvents substantially immiscible with water such as phenoxyethanol, followed by dispersion in water or hydrophilic colloids, and the resulting dispersions may be added to the emulsions. Further, the dyes may be directly dispersed in hydrophilic colloids, and the dispersions may be added to the emulsion as described in JP-A-53-102733 and JP-A-58-105141.

The sensitizing dyes may be added to the emulsions at any stage of emulsion preparation which has hitherto been known to be useful. Namely, they may be added at any stage before grain formation of the silver halide emulsions, during grain formation, immediately after grain formation to before washing, before chemical sensitization, during chemical sensitization, immediately after chemical sensitization to cooling to solidification of the emulsions, and on the preparation of coating solutions.

Although the sensitizing dyes are usually added between the time when chemical sensitization is completed and the time when the emulsions are applied, the sensitizing agents may be added concurrently with addition of the chemical sensitizing agents to carry out spectral sensitization and chemical sensitization at the same time, as described in U.S. Pat. Nos. 3,628,969 and 4,225,666. Further, the sensitizing agents can also be added prior to chemical sensitization as described in JP-A-58-113928, or can also be added before completion of precipitation formation of the silver halide grains to initiate spectral sensitization. Furthermore, it is also possible to divide each of the spectrally sensitizing dyes into portions to add each of the portions, namely to add a portion of the dye before chemical sensitization and the remainder after chemical sensitization, as described in U.S. Pat. No. 4,225,666. The method disclosed in U.S. Pat. No. 4,183,756 may also be used. The spectrally sensitizing dyes may be added at any time during formation of the silver halide grains.

It is particularly preferred to add the sensitizing dyes before washing of the emulsions or before chemical sensitization.

These spectrally sensitizing dyes are added in a wide range of amounts, as the case may be. The amount added is preferably $0.5\times10^{-6}$ to $1.0\times10^{-2}$ mol/mol of silver halide, and more preferably $1.0\times10^{-6}$ to $5.0\times10^{-3}$ mol.

In the present invention, when sensitizing dyes having spectral sensitization sensitivity in red to infrared regions are used, compounds as described on page 13, lower right column to page 22, lower right column of JP-A-2-157749 are preferably used in combination with the sensitizing dyes. The use of these compounds specifically enhances keeping quality of photographic materials, processing stability and supersensitization effect. It is particularly preferred to use the compounds represented by general formulae (IV), (V) and (VI) in JP-A-2-157749 described above in combination with the sensitizing dyes. These compounds are used in an amount of $0.5\times10^{-5}$ to $5.0\times10^{-3}$ mol/mol of silver halide, preferably $5.0\times10^{-5}$ to $5.0\times10^{-3}$ mol, and the advantageous amount used is 0.1 to 10000 times the amount of sensitizing dye on a molar basis, and preferably 0.5 to 5000 times.

The photographic materials of the present invention may be exposed to visible light or infrared light. Exposing methods may be either low illuminance exposure or high illumination exposure. The preferred exposing methods of high illumination include laser scanning exposing methods in which the exposing time is shorter than $10^{-4}$ second, more preferably shorter than $10^{-6}$ second.

In exposing, the band stop filter described in U.S. Pat. No. 4,880,726 is preferably used, whereby optical color mixing is eliminated and color reproducibility is markedly improved.

The exposed photographic materials can be subjected to conventional color development processing. In the case of color photographic materials of the present invention, it is preferred that bleaching-fixing be conducted after color development for rapid processing. In particular, when the above-described high silver chloride emulsion is used, the pH of a bleaching-fixing solution is preferably about 6.5 or less, and more preferably about 6 or less for the purpose of enhancing desilverization.

Silver halide emulsions, other materials (such as additives) and photographic constituent layers (such as layer arrangements) applied to the photographic materials of the present invention, and processing methods and additives for processing applied to treat the photographic materials, which are preferably used, are described in the following patents shown in Table 1, particularly in European Patent (EP) 0,355,660A2 (JP-A-2-139544).

TABLE 1

| Photographic Constituents, etc. | JP-A-62-215272 | JP-A-2-33144 | EP0,355,660A2 |
|---|---|---|---|
| Silver Halide Emulsions | Page 10, upper right column, line 6 to page 12, lower column, line 5; page 12, lower right column, line 4 from the bottom to page 13, upper left column, line 17 | Page 28, upper right column, line 16 to page 29, lower right column, line 11; page 30, line 2 to line 5 | Page 45, line 53 to page 47, line 3; page 47, line 20 to line 22 |
| Solvents for Silver Halides | Page 12, lower left column, line 6 to line 14; page 13, upper left column, line 3 from the bottom to page 18, lower left column, the last line | — | — |
| Chemical Sensitizers | Page 12, lower left column, line 3 from the bottom to lower right column, line 5 from the bottom; page 18, lower right column, line 1, to page 22, upper right column, line 9 from the bottom | Page 29, lower right column, line 12 to the last line | Page 47, line 4 to line 9 |
| Spectrally Sensitizing Agents (Spectrally Sensitizing Methods) | Page 22, upper right column, line 8 from the bottom to page 38, the last line | Page 30, upper left column, line 1 to line 13 | Page 47, line 10 to line 15 |
| Emulsin Stabilizers | Page 39, upper left column, line 1 to page 72, upper right column, the last line | Page 30, upper left column, line 14 to upper right column, line 1 | Page 47, line 16 to line 19 |
| Development Accelerators | Page 72, lower left column, line 1 to page 91, upper right column, line 3 | — | — |
| Color Couplers (Cyan, Magenta, Yellow Couplers) | Page 91, upper right column, line 4 to page 121, upper left column, line 6 | Page 3, upper right column, line 14 to page 18, upper left column, the last line; page 30, upper right column, line 6 to page 35, lower right column, line 11 | Page 4, line 15 to line 27; page 5, line 30 to page 28, the last line; page 49, line 29 to line 31; page 47, line 23 to page 63, line 50 |
| Color Development Increasing Agents | Page 121, upper left column, line 7 to page 125, upper right column, line 1 | — | — |
| Ultraviolet Absorbers | Page 125, upper right column, line 2 to page 127, lower left column, the last line | Page 37, lower right column, line 14 to page 38, upper left column, line 11 | Page 65, line 22 to line 31 |
| Antifading Agents (Image Stabilizers) | Page 127, lower right column, line 1 to page 137, lower left column, line 8 | Page 36, upper right column, line 12 to page 37, upper left column, line 19 | Page 4, line 30 to page 5, line 23; page 29, line 1 to page 45, line 25; page 45, line 33 to line 40; page 65, line 2 to line 21 |
| High Boiling and/or Low Boiling Organic Solvents | Page 137, lower left column, line 9 to page 144, upper right column, the last line | Page 35, lower right column, line 14 to page 36, upper left column, line 4 from the bottom | Page 64, line 1 to line 51 |
| Dispersing Methods of Photographic Additives | Page 144, lower left column, line 1 to page 146, upper right column, line 7 | Page 27, lower right column, line 10 to page 28, upper left column, the last line; page 35, lower right column, line 12 to page 36, upper right column, line 7 | Page 63, line 51 to page 64, line 56 |
| Hardeners | Page 146, upper right column, line 8 to page 155, lower left column, line 4 | — | — |
| Developing Agent Precursors | Page 155, lower left column, line 5 to lower right column, line 2 | — | — |
| Development Restrainer-Releasing Compounds | Page 155, lower right column, line 3 to line 9 | — | — |
| Supports | Page 155, lower right column, line 19 to page 156, upper left column, line 14 | Page 38, upper right column, line 18 to page 39, upper left column, line 3 | Page 66, line 29 to page 67, line 13 |
| Photographic Material Layer Constitution | Page 156, upper left column, line 15 to page 156, lower right column, line 14 | Page 28, upper right column, line 1 to line 15 | Page 45, line 41 to line 52 |
| Dyes | Page 156, lower right column, line 15 to page 184, lower right column, the last line | Page 38, upper left column, line 12 to upper right column, line 7 | Page 66, line 18 to line 22 |
| Color Mixing Inhibitors | Page 185, upper left column, line 1 to lower right column, line 3 | Page 36, upper right column, line 8 to line 11 | Page 64, line 57 to page 65, line 1 |
| Gradation Modifiers | Page 188, lower right column, | — | — |

TABLE 1-continued

| Photographic Constituents, etc. | JP-A-62-215272 | JP-A-2-33144 | EP0,355,660A2 |
|---|---|---|---|
| | line 4 to line 8 | | |
| Stain Inhibitors | Page 188, lower right column, line 9 to page 193, lower right column, line 10 | Page 37, upper right column, the last line to lower right column, line 13 | Page 65, line 32 to page 66, line 17 |
| Surfactants | Page 201, lower left column, line 1 to page 210, upper right column, the last line | Page 18, upper right column, line 1 to page 24, lower right column, the last line; page 27, lower left column, line 10 from the bottom to lower right column, line 9 | — |
| Fluorine-Containing Compounds (Antistatic Agents, Coating Aids, Lubricants, Adhesion Inhibitors) | Page 210, lower right column, line 1 to page 222, lower left column, line 5 | Page 25, upper left column, line 1 to page 27, lower right column, line 9 | — |
| Binders (Hydrophilic Colloids) | Page 222, lower left column, line 6 to page 225, upper left column, the last line | Page 38, upper right column, line 8 to line 18 | Page 66, line 23 to line 28 |
| Tackifiers | Page 225, upper right column, line 1 to page 227, upper right column, line 2 | — | — |
| Antistatic Agents | Page 227, upper right column, line 3 to page 230, upper left column, line 1 | — | — |
| Polymer Latices | Page 230, upper left column, line 2 to page 239, the last line | — | — |
| Matting Agents | Page 240, upper left column, line 1 to upper right column, the last line | — | — |
| Photographic Processing Methods (Processing Stages and Additives) | Page 3, upper right column, line 7 to page 10, upper right column, line 5 | Page 39, upper left column, line 4 to page 42, upper left column, the last line | Page 67, line 14 to page 69, line 28 |

Note: The cited portions of JP-A-62-215272 include the contents of the amendment dated March, 16, 1987 which was given in the end of this publication. In addition, of the above-described color couplers, as yellow couplers, so-called short wave type yellow couplers are also preferably used which are described in JP-A-63-231451, JP-A63-123047, JP-A-63-241547, JP-A-1-173499, JP-A-1-213648 and JP-A-1-250944.

Cyan, magenta or yellow couplers are preferably impregnated with loadable latex polymers (for example, U.S. Pat. No. 4,203,716) in the presence (or in the absence) of the boiling organic solvents shown in the above table, or dissolved together with water-insoluble, organic solvent-soluble polymers to emulsify them in aqueous solutions of hydrophilic colloids.

The water-insoluble, organic solvent-soluble polymers which can be preferably used include homopolymers or copolymers described in columns 7 to 15 of U.S. Pat. No. 4,857,449 and on pages 12 to 30 of PCT International Publication No. W088/00723. More preferably, the use of methacrylate or acrylamide polymers, particularly the use of the acrylamide polymers, is preferable in respect to image stabilization.

In the photographic materials of the present invention, compounds for improving the keeping quality of color images as described in European Patent (EP) 0,277,589A2 are preferably used in combination with the couplers. In particular, they are preferably used in combination with pyrazoloazole couplers or pyrrolotriazole couplers.

Namely, in order to prevent the production of stains due to a color developing dye formed by reaction of a color developing agent remaining in a film or an oxide thereof with a coupler during storage after processing, and other side effects, it is preferred to use the compound described in the above-described patent specification which is chemically bonded to an aromatic amine developing agent remaining after color development to form a chemically inactive, substantially colorless compound and/or the compound described in the above-described patent specification which is chemically bonded to an oxide of the aromatic amine color developing agent remaining after color development to form a chemically inactive, substantially colorless compound, alone or in combination.

Cyan couplers preferably used include 3-hydroxypyridine cyan couplers described in European Patent (EP) 0,333,185A2 (a coupler obtained by giving a chlorine eliminable group to a 4-equivalent coupler of coupler (42) specifically exemplified to form a 2-equivalent coupler, and couplers (6) and (9) are particularly preferred among others), cyclic active methylene cyan couplers described in JP-A-64-32260 (couplers 3, 8 and 34 specifically exemplified are particularly preferred among others), pyrrolopyrazole cyan couplers described in European Patent (EP) 456,226A1, pyrroloimidazole cyan couplers described in European Patent (EP) 0,484,909, and pyrrolotriazole cyan couplers described in European Patents (EP) 0,488,248 and 0,491,197A1, as well as diphenylimidazole cyan couplers described in JP-A-2-33144.

Yellow couplers preferably used include acylacetamide yellow couplers described in European Patent (EP) 0,447,969A1 in which an acyl group has a 3 to 5-membered cyclic structure, malondianilide yellow couplers having a cyclic structure described in European Patent (EP) 0,482,552A1 and acylacetamide yellow couplers having a dioxane structure described in U.S. Pat. No. 5,118,599, as well as the compounds described in the above table. Of these, the acylacetamide yellow couplers in which the acyl group is a 1-alkylcyclopropane-1-carbonyl group, and the malondianilide yellow couplers in which one of the anilides constitutes an indoline ring are preferably used. These couplers can be used alone or in combination.

Magenta couplers used in the present invention include 5-pyrazolone magenta couplers and pyrazoloazole magenta couplers as described in the literatures shown in the above table. In respect to hue, image stability and color forming property, magenta couplers preferably used include pyrazolotriazole couplers as described in JP-A-61-65245 in which a secondary or tertiary alkyl group is directly bonded to the 2-, 3- or 6-position of a pyrazolotriazole ring, pyrazoloazole couplers as described in JP-A-61-65246 in which a sulfonamido group is contained in the molecule, pyrazoloazole couplers having an alkoxyphenylsulfonamido-ballast group as described in JP-A-61-147254 and pyrazoloazole couplers having an alkoxy group or an aryloxy group at the 6-position as described in European Patents 226,849A and 294,785A.

As methods for processing the color photographic materials of the present invention, processing materials and processing methods described on page 26, lower right column, line 1 to page 34, upper right column, line 9 of JP-A-2-207250, and on page 5, upper left column, line 17 to page 18, lower right column, line 20 of JP-A-4-97355, in addition to the methods described in the above table, are preferably used.

The present invention will be further illustrated in greater detail with reference to the following examples, which are however not to be construed as limiting the invention. Unless otherwise indicated herein, all parts, percents, ratios and the like are by weight.

EXAMPLE 1

To a 3% aqueous solution of gelatin treated with lime, 6.6 g of sodium chloride was added, and 3.2 ml of N,N'-dimethylimidazolidine-2-thione (1% aqueous solution) was added thereto. This solution was adjusted to pH 3.5, and then an aqueous solution containing 0.2 mol of silver nitrate and an aqueous solution containing 0.12 mol of sodium chloride and 0.8 mol of potassium bromide were added thereto while mixing at 72° C. with vigorous stirring. Subsequently, an aqueous solution containing 0.8 mol of silver nitrate and an aqueous solution containing 0.48 mol of sodium chloride and 0.32 mol of potassium bromide were added thereto while mixing at 72° C. with vigorous stirring. Over an interval from the time when seven eighths the amount of the reaction solution added at the second time was added to the time when the whole amount was completely added, $2\times10^{-8}$ mol of potassium hexachloroiridate (IV) was introduced into the reaction vessel. The resulting mixture was kept at 72° C. for 5 minutes, followed by desilverization and washing. Further, 90.0 g of gelatin treated with lime was added thereto. The resulting emulsion was adjusted to pH 6.5. Spectrally sensitizing dye B-1 was added at 58° C., and sodium thiosulfate and chloroauric acid were further added to conduct spectral sensitization, sulfur sensitization and gold sensitization. On termination of chemical sensitization, 80 mg of 1-(3-methylureidophenyl)-5-mercaptotetrazole was added for the purpose of stabilization and prevention of fogging. The silver chlorobromide emulsion thus obtained (mean grain size: 0.79 μm, coefficient of variation in grain size distribution: 7%, cubic, silver bromide: 40 mol %) was named Emulsion 1B1.

Then, an emulsion was prepared in the same manner as Emulsion 1B1 with the exception that the ratios of sodium chloride and potassium bromide were changed. The amounts of the sulfur sensitizing agent and the gold sensitizing agent were controlled so as to give optimum chemical sensitization. The grains of the resulting silver chlorobromide emulsion were in cubic form with a mean grain size of 0.78 μm and a coefficient of variation in grain size distribution of 6% and contained 2 mol % of silver bromide. This emulsion was named Emulsion 1B2.

In the same manner as with Emulsion 1B1 with the exception that the temperature on grain formation was changed and the spectrally sensitizing dye was changed to G-1, emulsion grains having a mean grain size of 0.41 μm and a coefficient of variation in grain size distribution of 8% were prepared. This emulsion was named Emulsion 1G1.

Further, in the same manner as with Emulsion 1B2 with the exception that the temperature on grain formation was changed and the spectrally sensitizing dye was changed to G-1, emulsion grains having a mean grain size of 0.40 μm and a coefficient of variation in grain size distribution of 7% were prepared. This emulsion was named Emulsion 1G2.

Then, in the same manner as with Emulsion 1B1 with the exception that the temperature on grain formation was changed and the spectrally sensitizing dye was changed to R-1 and Compound R-2, emulsion grains having a mean grain size of 0.51 μm and a coefficient of variation in grain size distribution of 8% were prepared. This emulsion was named Emulsion 1R1.

Furthermore, in the same manner as with Emulsion 1B2 with the exception that the temperature on grain formation was changed and the spectrally sensitized dye was changed to R-1 and R-2, emulsion grains having a mean grain size of 0.52 μm and a coefficient of variation in grain size distribution of 7% were prepared. This emulsion was named Emulsion 1R2.

In the preparation of these emulsions, the amount of potassium hexachloroiridate (IV) added on grain formation was changed in reverse proportion to the volume of the grains of each emulsion.

Further, the amounts of the sulfur sensitizing agent and the gold sensitizing agent were controlled so as to give optimum chemical sensitization.

The spectrally sensitizing dyes used in the preparation of these emulsions and the amounts added thereof are as follows:

Blue-Sensitive Emulsion Layer
Sensitizing Dye B-1
A mixture of

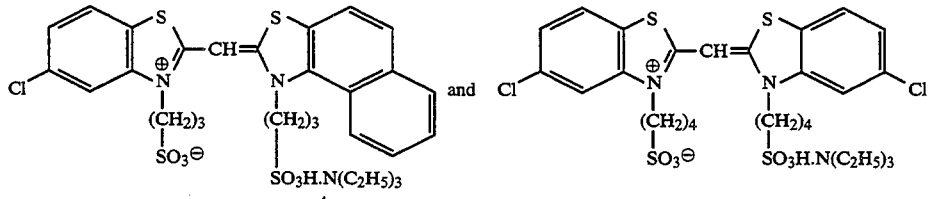

(added in a total amount of $4.0\times10^{-4}$ mol per mol of silver halide)

Green-Sensitive Emulsion Layer
Sensitizing Dye G-1
A mixture of

-continued

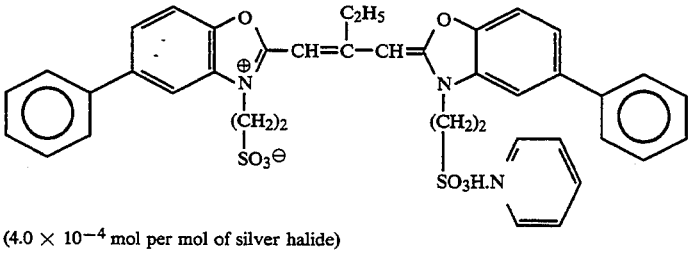

($4.0 \times 10^{-4}$ mol per mol of silver halide)

and

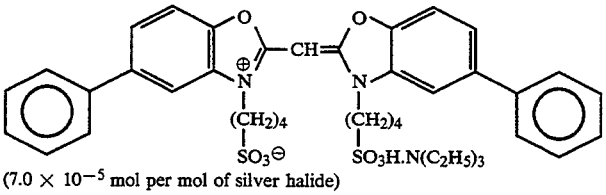

($7.0 \times 10^{-5}$ mol per mol of silver halide)

Red-Sensitive Emulsion Layer
A mixture of
Spectrally Sensitizing Dye R-1

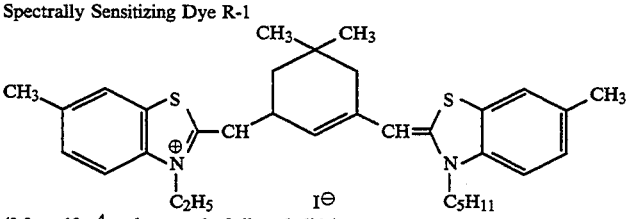

($0.9 \times 10^{-4}$ mol per mol of silver halide)

and

Compound R-2

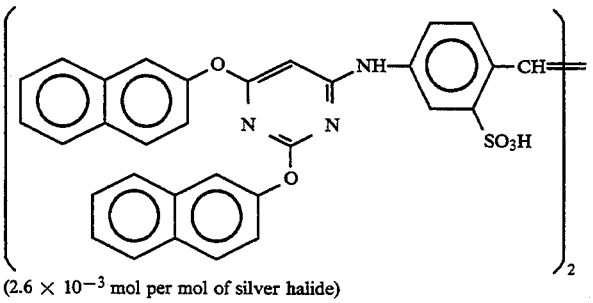

($2.6 \times 10^{-3}$ mol per mol of silver halide)

Using these silver halide emulsions, multilayer color photographic paper was prepared according to the following method. A paper support both sides of which were laminated with polyethylene was prepared by the method described in the example of JP-A-3-156439, and polyethylene on the side on which silver halide emulsion layers formed contained 13% by weight of titanium dioxide. The surface of this paper support was subjected to corona discharge treatment. Then, gelatin undercoat containing sodium dodecylbenzenesulfonate was provided thereon, and various photographic constituting layers were further formed thereon to prepare multilayer color photographic paper samples (101) and (102). Coating solutions for the respective layers were prepared as follows: *Preparation of Coating Solution for First Layer*

153.0 g of yellow coupler (ExY), 15.0 g of color image stabilizer (Cpd-1), 7.5 g of color image stabilizer (Cpd-2) and 16.0 g of color image stabilizer (Cpd-3) were dissolved in 25 g of solvent (Solv-1), 25 g of solvent (Solv-2) and 180 cc of ethyl acetate. The resulting solution was emulsified and dispersed in 1000 g of a 10% aqueous solution of gelatin containing 60 cc of a 10% aqueous solution of sodium dodecylbenzene-sulfonate and 10 g of citric acid to prepare emulsified dispersion A.

On the other hand, a silver chlorobromide emulsion prepared by the method previously described and this emulsified dispersion A were mixed with each other to prepare a coating solution for a first layer so as to give the composition shown below.

Coating solutions for the second to seventh layers were also prepared similarly with the coating solution for the first layer. As a gelatin hardener for each layer, the sodium salt of 1-oxy-3,5-dichloro-s-triazine was used.

Cpd-14 and Cpd-15 were added to each layer to total amounts of 25 mg/m$^2$ and 50 mg/m$^2$, respectively.

Further, 1-(5-methylureidophenyl)-5-mercaptotetrazole was added to the blue-sensitive emulsion layer, the green-sensitive emulsion layer and the red-sensitive emulsion layer in amounts of $6\times10^{-5}$ mol, $7.8\times10^{4}$ mol and $2.2\times10^{-4}$ mol per mol of silver halide, respectively.

Furthermore, 4-hydroxy-6-methyl-1,3,3a,7-tetraazaindene was added to the blue-sensitive emulsion layer and the green-sensitive emulsion layer in amounts of $1\times10^{-4}$ mol and $2\times10^{-4}$ mol per mol of silver halide, respectively.

In addition, the following dyes were added to the emulsion layers for prevention of irradiation (the numerical values in parentheses indicate weights coated):

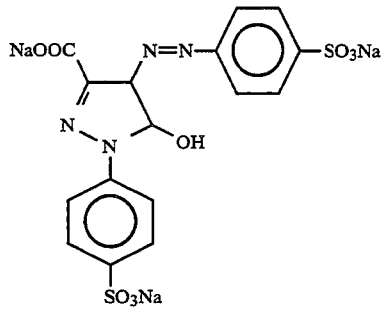

(10 mg/m²)

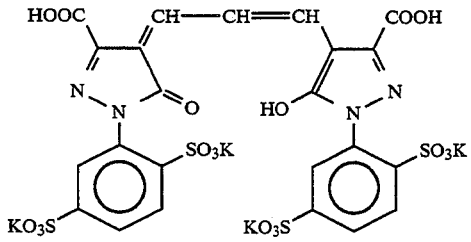

(10 mg/m²)

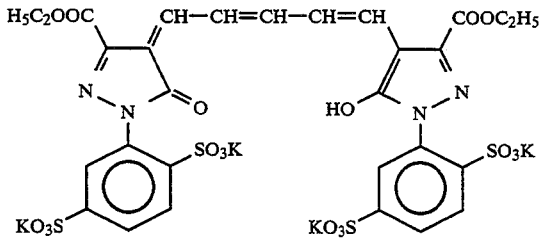

(40 mg/m²)

and

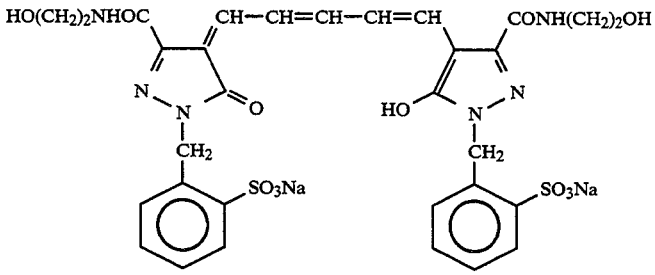

(20 mg/m²)

With respect to the emulsions used in the respective emulsion layers, Emulsions 1B1, 1G1 and 1R1 were used in the blue-sensitive emulsion layer, the green-sensitive emulsion layer and the red-sensitive emulsion layer, respectively, for sample (101), and Emulsions 1B2, 1G2 and 1R2 were used in the blue-sensitive emulsion layer, the green-sensitive emulsion layer and the red-sensitive emulsion layer, respectively, for sample (102).

Support

Paper Laminated with Polyethylene (polyethylene on the first layer side contains a white pigment ($TiO_2$) and a bluing dye (ultramarine))

| | |
|---|---|
| First Layer (Blue-Sensitive Emulsion Layer) | |
| Silver Chlorobromide Emulsion 1B1 or 1B2 Described Above | 0.27 |
| Gelatine | 1.36 |
| Yellow Coupler (ExY) | 0.79 |
| Color Image Stabilizer (Cpd-1) | 0.08 |
| Color Image Stabilizer (Cpd-2) | 0.04 |
| Color Image Stabilizer (Cpd-3) | 0.08 |
| Solvent (Solv-1) | 0.13 |
| Solvent (Solv-2) | 0.13 |
| Second Layer (Color Mixing Preventing Layer) | |
| Gelatin | 1.00 |
| Color Mixing Inhibitor (Cpd-4) | 0.06 |
| Solvent (Solv-7) | 0.03 |
| Solvent (Solv-2) | 0.25 |
| Solvent (Solv-3) | 0.25 |
| Third Layer (Green-Sensitive Emulsion Layer) | |
| Silver Chlorobromide Emulsion 1G1 or 1G2 Described Above | 0.13 |
| Gelatin | 1.45 |
| Magenta Coupler (ExM) | 0.16 |
| Color Image Stabilizer (Cpd-5) | 0.15 |
| Color Image Stabilizer (Cpd-2) | 0.03 |
| Color Image Stabilizer (Cpd-6) | 0.01 |
| Color Image Stabilizer (Cpd-7) | 0.01 |
| Color Image Stabilizer (Cpd-8) | 0.08 |
| Solvent (Solv-3) | 0.50 |
| Solvent (Solv-4) | 0.15 |
| Solvent (Solv-5) | 0.15 |
| Fourth Layer (Color Mixing Preventing Layer) | |
| Gelatin | 0.70 |
| Color Mixing Inhibitor (Cpd-4) | 0.04 |

-continued

| | |
|---|---|
| Solvent (Solv-7) | 0.02 |
| Solvent (Solv-2) | 0.18 |
| Solvent (Solv-3) | 0.18 |
| Fifth Layer (Red-Sensitive Emulsion Layer) | |
| Silver Chlorobromide Emulsion 1R1 or 1R2 Described Above | 0.20 |
| Gelatin | 0.85 |
| Cyan Coupler (ExC) | 0.33 |
| Ultraviolet Light Absorber (UV-2) | 0.18 |
| Color Image Stabilizer (Cpd-1) | 0.32 |
| Color Image Stabilizer (Cpd-9) | 0.01 |
| Color Image Stabilizer (Cpd-10) | 0.01 |
| Color Image Stabilizer (Cpd-11) | 0.01 |
| Solvent (Solv-6) | 0.22 |
| Color Image Stabilizer (Cpd-8) | 0.01 |
| Color Image Stabilizer (Cpd-6) | 0.01 |
| Solvent (Solv-1) | 0.01 |
| Sixth Layer (Ultraviolet Light Absorbing Layer) | |
| Gelatin | 0.55 |
| Ultraviolet Light Absorber (UV-1) | 0.38 |
| Color Image Stabilizer (Cpd-12) | 0.15 |
| Color Image Stabilizer (Cpd-5) | 0.02 |
| Seventh Layer (Protective Layer) | |
| Gelatin | 1.13 |
| Acrylic Modified Copolymer of Polyvinyl Alcohol (degree of modification: 17%) | 0.05 |
| Liquid Paraffin | 0.02 |
| Color Image Stabilizer (Cpd-13) | 0.01 |

ExY Yellow Coupler:

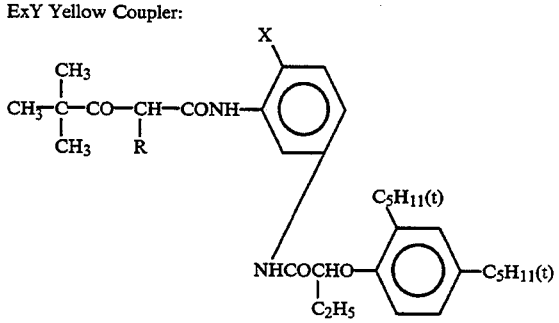

A 1:1 mixture (molar ratio) of

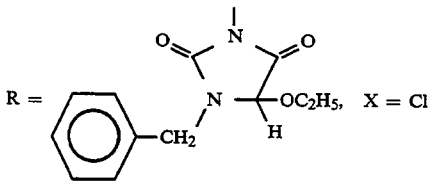

and

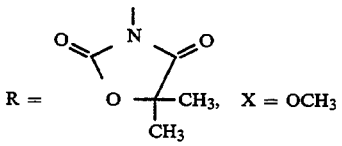

ExM Magenta Coupler:

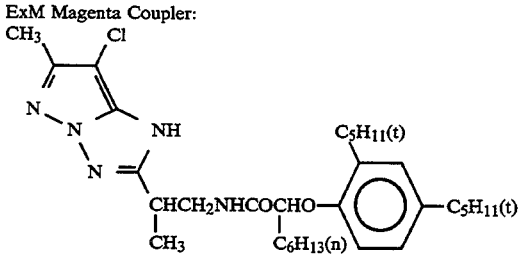

ExC Cyan Coupler:

-continued

A 3:7 mixture (molar ratio) of

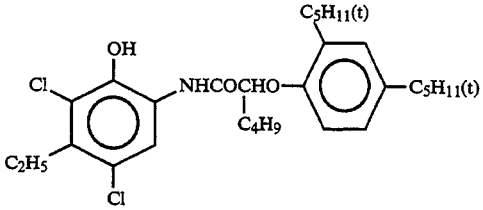

and

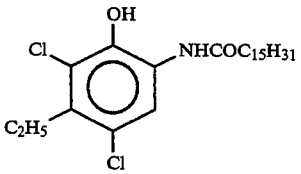

(Cpd-1) Color Image Stabilizer:

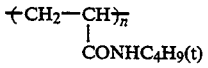

(average molecular weight: 60,000)

(Cpd-2) Color Image Stabilizer:

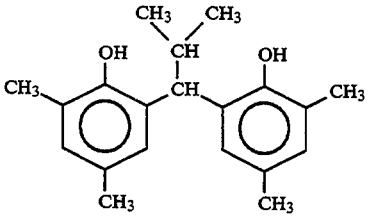

(Cpd-3) Color Image Stabilizer:

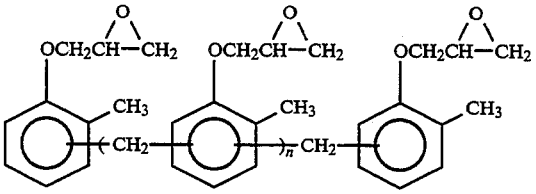

n = 7–8 (average value)

(Cpd-4) Color Mixing Inhibitor:

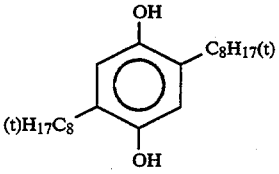

(Cpd-5) Color Image Stabilizer:

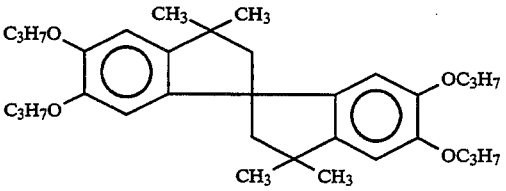

(Cpd-6) Color Image Stabilizer:

-continued

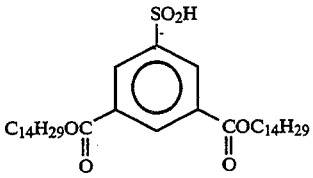

(Cpd-7) Color Image Stabilizer:

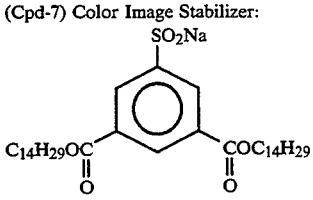

(Cpd-8) Color Image Stabilizer:

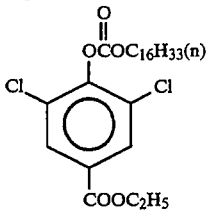

(Cpd-9) Color Image Stabilizer:

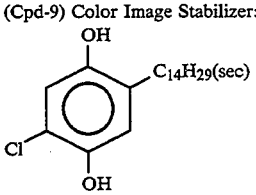

(Cpd-10) Color Image Stabilizer:

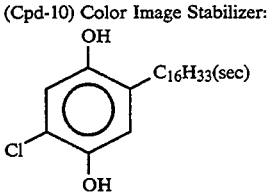

(Cpd-11) Color Image Stabilizer:

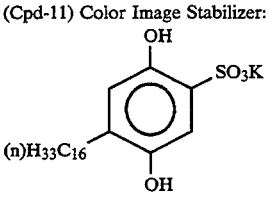

(Cpd-12) Color Image Stabilizer:

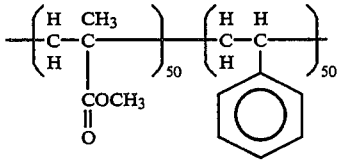

(average molecular weight: 60,000)

(Cpd-13) Color Image Stabilizer:

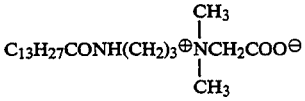

(Cpd-14) Preservative:

-continued

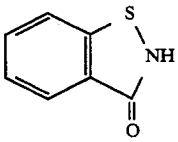

(Cpd-15) Preservative:

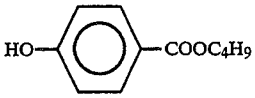

(UV-1) Ultraviolet Light Absorber:
A 1:5:10:5 mixture (weight ratio) of (1), (2), (3) and (4)

(1)

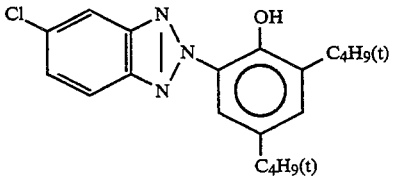

(2)

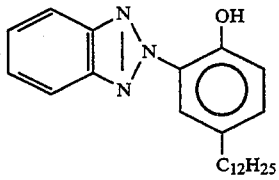

(3)

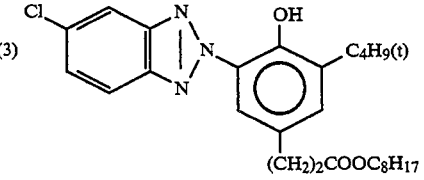

(4)

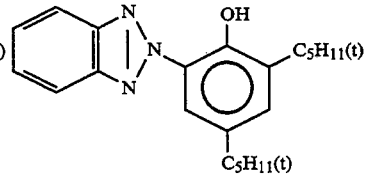

(UV-2) Ultraviolet Light Absorber:
A 1:2:2 mixture (weight ratio) of (1), (2) and (3)

(1)

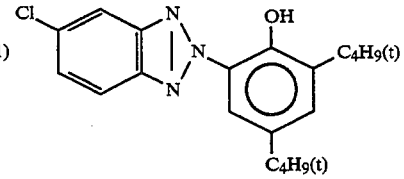

(2)

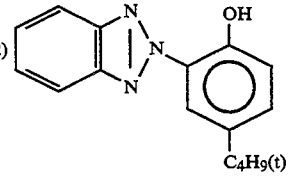

-continued (3)

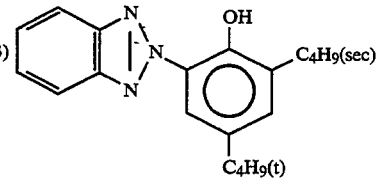

(Solv-1) Solvent:

$C_8H_{17}CHCH(CH_2)_7COOC_8H_{17}$ (O)

(Solv-2) Solvent:

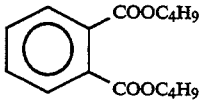

(Solv-3) Solvent:

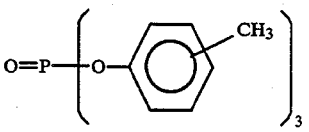

(Solv-4) Solvent:

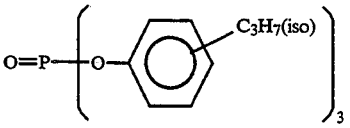

(Solv-5) Solvent:

$O{=}P{-}(OCH_2CH(C_2H_5)C_4H_9(n))_3$ (Solv-6) Solvent:

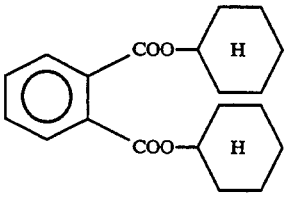

(Solv-7) Solvent:

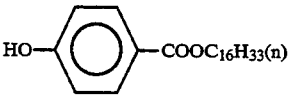

Samples (103) to (106) were prepared in the same manner as color photographic paper samples (101) and (102) with the exception that the supports used to prepare the photographic materials were substituted by supports containing 15% by weight and 50% by weight of titanium dioxide (using an electron beam-hardenable resin) according to the example described in JP-A-3-156439.

Further, samples (107) to (112) were prepared in the same manner as color photographic paper samples (101) and (102) with the exception that hydrophilic colloidal layers containing various amounts of titanium dioxide as a white pigment were formed between the supports and the first layers.

A coating solution for the titanium dioxide-containing layers was prepared as follows.

400 g of a rutile type white titanium pigment having a mean grain size of 0.23 μm (Titanium White R780, Ishihara Sangyo Kaisha) and 4,000 cc of water were added to 1,000 g of a 10% aqueous solution of gelatin from which calcium was removed by ion exchange, and 8 cc of a 5% aqueous solution of sodium dodecylbenzenesulfonate was added as a dispersing agent, followed by ultrasonic dispersion.

The coating solution thus obtained was applied to bring the amounts of titanium dioxide applied to 1.5 $g/m^2$ (samples (107) and (108)), 3.5 $g/m^2$ (samples (109) and (110)) and 8.0 $g/m^2$ (samples (111) and (112)).

The total amount of calcium contained in the photographic layers constituting each of these samples was 16 mg.

Gelatin used in each emulsion layer of samples (101) to (112) was substituted by gelatin whose calcium content was reduced by ion exchange to prepare samples (101a) to (112a) having a total calcium content of 8 mg and samples (101b) to (112b) having a total calcium content of 2 mg.

The resulting photographic materials were subjected to exposure for sensitometry through an optical wedge and a color filter at 250 CMS for 1 second using a sensitometer (FWH type, Fuji Photo Film Co., Ltd., color temperature of light source: 3,200° K.), followed by color development processing using the following processing stages and solutions. In order to evaluate the aptitude for rapid processing of each sample, the processing time taken to reach the maximum developed color density for all of yellow, magenta and cyan was determined.

Then, in order to determine the sharpness of each sample, rectangular patterns having different rectangular line numbers per unit width with a density difference of 0.5 which were evaporated onto a glass base was adhered to each sample, and the sample was exposed, followed by color development processing using the following processing stages and solutions. The exposure was conducted through a green filter so as to obtain magenta color development most sensitive to the human eye. The developing time at this time was 45 seconds. The density of the resulting rectangular images was precisely measured with a microdensitometer to determine the spatial frequency to give a CTF value of 0.5, which was used as a measure.

For the purpose of examining the development of fogging when bending force was applied to color photographic paper, a sample before exposure was bent to an angle of 40° around a stainless steel round bar having a diameter of 2 mm, and the density of fogging (B density) developed after development processing (45 sec) was measured.

Of the results of the above-described tests, results of developing speed and sharpness were little dependent on the amount of calcium contained in the photographic materials. Accordingly, results of samples (101) to (112) were used as representatives.

Results thereof are summarized in Table 2.

TABLE 2

| Sample | Silver Halide Emulsion Used (Halogen Comp.) | $TiO_2$ Content in Coating Resin (wt %) | $TiO_2$—Containing Hydrophilic Colloidal Layer (Amount of $TiO_2$) ($g/m^2$) | Time Reaching Maximum Developed Color Density (sec) | Sharpness (CTF Value) | Pressure Fogging Value: Ca Content ($mg/m^2$) | Pressure Fogging Value: Change in B Density | Remark |
|---|---|---|---|---|---|---|---|---|
| 101 | 1B1,1G1,1R1(AgCl = 60%) | 13 | Not contained | 102 | 13.3 | 16 | +0.01 | Comparison |
| 101a | " | " | " | | | 8 | +0.01 | Comparison |
| 101b | " | " | " | | | 2 | +0.00 | Comparison |
| 102 | 1B2,1G2,1R2(AgCl = 98%) | 13 | Not contained | 31 | 13.7 | 16 | +0.02 | Comparison |
| 102a | " | " | " | | | 8 | +0.02 | Comparison |
| 102b | " | " | " | | | 2 | +0.01 | Comparison |
| 103 | 1B1,1G1,1R1(AgCl = 60%) | 15 | Not Contained | 107 | 14.6 | 16 | +0.02 | Comparison |
| 103a | " | " | " | | | 8 | +0.02 | Comparison |
| 103b | " | " | " | | | 2 | +0.01 | Comparison |
| 104 | 1B2,1G2,1R2(AgCl = 98%) | 15 | Not contained | 29 | 15.1 | 16 | +0.04 | Comparison |
| 104a | " | " | " | | | 8 | +0.02 | Invention |
| 104b | " | " | " | | | 2 | +0.01 | Invention |
| 105 | 1B1,1G1,1R1(AgCl = 60%) | 50 | Not contained | 104 | 19.3 | 16 | +0.02 | Comparison |
| 105a | " | " | " | | | 8 | +0.02 | Comparison |
| 105b | " | " | " | | | 2 | +0.01 | Comparison |
| 106 | 1B2,1G2,1R2(AgCl = 98%) | 50 | Not contained | 30 | 19.9 | 16 | +0.05 | Comparison |
| 106a | " | " | " | | | 8 | +0.02 | Invention |
| 106b | " | " | " | | | 2 | +0.02 | Invention |
| 107 | 1B1,1G1,1R1(AgCl = 60%) | 13 | Contained(1.5) | 105 | 13.1 | 16 | +0.02 | Comparison |
| 107a | " | " | " | | | 8 | +0.02 | Comparison |
| 107b | " | " | " | | | 2 | +0.01 | Comparison |
| 108 | 1B2,1G2,1R2(AgCl = 98%) | 13 | Contained(1.5) | 31 | 13.5 | 16 | +0.06 | Comparison |
| 108a | " | " | " | | | 8 | +0.02 | Comparison |
| 108b | " | " | " | | | 2 | +0.02 | Comparison |
| 109 | 1B1,1G1,1R1(AgCl = 60%) | 13 | Contained(3.5) | 104 | 21.6 | 16 | +0.03 | Comparison |
| 109a | " | " | " | | | 8 | +0.02 | Comparison |
| 109b | " | " | " | | | 2 | +0.01 | Comparison |
| 110 | 1B2,1G2,1R2(AgCl = 98%) | 13 | Contained(3.5) | 30 | 21.8 | 16 | +0.07 | Comparison |
| 110a | " | " | " | | | 8 | +0.03 | Invention |
| 110b | " | " | " | | | 2 | +0.02 | Invention |
| 111 | 1B1,1G1,1R1(AgCl = 60%) | 13 | Contained(8.0) | 105 | 25.2 | 16 | +0.03 | Comparison |
| 111a | " | " | " | | | 8 | +0.03 | Comparison |
| 111b | " | " | " | | | 2 | +0.02 | Comparison |
| 112 | 1B2,1G2,1R2(AgCl = 98%) | 13 | Contained(8.0) | 29 | 25.7 | 16 | +0.09 | Comparison |
| 112a | " | " | " | | | 8 | +0.03 | Invention |
| 112b | " | " | " | | | 2 | +0.03 | Invention |

| Processing Stage | Temperature (°C.) | Time (sec) | Replenisher* (ml) | Tank Capacity (liter) |
|---|---|---|---|---|
| Color Development | 38 | see Table 2 | 90 | 1 |
| Bleaching-Fixing | 30–36 | 45 | 161 | 2 |
| Rinsing (1) | 30–35 | 30 | — | 2 |
| Rinsing (2) | 30–35 | 30 | — | 2 |
| Rinsing (3) | 30–35 | 30 | 200 | 2 |
| Drying | 70–80 | 60 | | |

*Replenishment rate: $ml/m^2$ of light-sensitive material

| | Tank Solution | Replenisher |
|---|---|---|
| Color Developing Solution: | | |
| Water | 800 ml | 800 ml |
| Ethylenediamine-N,N,N,N-tetramethylenephosphonic Acid | 3.0 g | 6.0 g |
| Potassium Bromide | 0.015 g | — |
| Triethanolamine | 10.0 g | 10.0 g |
| Sodium Chloride | 4.2 g | — |
| Potassium Carbonate | 25 g | 25 g |
| N-Ethyl-N-(β-methanesulfonamidoethyl)-3-methyl-4-aminoaniline Sulfate | 5.0 g | 11.0 g |
| N,N-Bis(carboxymethyl)hydrazine | 4.4 g | 10.4 g |
| N,N-Di(sulfoethyl)hydroxylamine.1Na | 4.0 g | 8.0 g |
| Fluorescent Brightener (WHITEX 4B, Sumitomo Chemical Co., Ltd.) | 2.0 g | 4.0 g |
| Water to make | 1,000 ml | 1,000 ml |
| pH | 10.20 | 10.85 |
| Bleaching-Fixing Solution (tank solution and replenisher being the same) | | |
| Water | 400 ml | |
| Ammonium Thiosulfate (700 g/liter) | 100 ml | |
| Sodium Sulfite | 17 g | |
| Ethylenediaminetetraacetic Acid Fe (III) Ammonium | 55 g | |
| Disodium Ethylenediaminetetraacetate | 5 g | |
| Ammonium Bromide | 40 g | |
| Glacial Acetic acid | 9 g | |
| Water to make | 1,000 ml | |
| pH | 5.40 | |
| Rinsing Solution (tank solution and replenisher being the same) | | |
| Ion-Exchanged Water (the content of each of calcium and magnesium being not more than 3 ppm.) | | |

The results show the following. The comparison between the developing time reaching the maximum developed color density of samples 101, 103, 105, 107, 109 and 111 prepared using the 60-mol % silver chloride emulsion and that of samples 102, 104, 106, 108, 110 and 112 prepared using the 98-mol % high silver chloride emulsion reveals that the use of high silver chloride emulsions permits rapid processing. However, when these high silver chloride emulsions are used, the increased content of titanium dioxide in the resin covering the emulsion coating side of the support, said resin being a means for enhancing sharpness, and formation of the gelatin layer with titanium dioxide dispersed therein at high density extremely increases the development of fogging when the photographic material is bent. To such problems, the development of fogging can be effectively inhibited by reducing the calcium content in the photographic material to 10 mg/m$^2$ or less.

The samples of the present invention exhibit high sharpness and little develop fogging even when the photographic material is bent, being excellent in handling ability.

EXAMPLE 2

Coloring material-containing layer A or B and an intermediate layer were formed between the support and the first layer of sample 106 prepared in Example 1 in this order from the support to prepare a multilayer color photographic paper.

Coloring material-containing layer A contained colloidal silver prepared by the following method as a coloring material.

To 1,000 g of a 10% aqueous solution of gelatin, 2 g of anhydrous sodium carbonate was added, and the mixture was kept at a temperature of 45° C. Then, 500 cc of a 10% aqueous solution of silver nitrate was added thereto, and 1,000 cc of an aqueous solution containing 35 g of anhydrous sodium sulfite and 25 g of hydroquinone was added for 10 minutes. After termination of addition, the solution was allowed to stand for 10 minutes, and then about 100 cc of 1N sulfuric acid was added to adjust the solution to pH 5.0. The resulting colloidal silver sol was poured into a cooling dish for sufficient gelation. Then, the gel was cut to the noodle form and washed with cold water for 6 hours, followed by desalting to obtain a colloidal silver dispersion.

Coloring material-containing layer B contained a solid dispersion of a dye prepared by the following method as a coloring material.

In a 700-cc pot mill, 21.7 cc of water, 3.0 cc of a 5% aqueous solution of sodium p-octylphenoxyethoxyethane-sulfonate and 0.5 g of p-octylphenoxy polyoxyethylene (polymerization degree 10) ether were .placed, and 1.65 g of dye D-1 and 500 cc of beads (having a diameter of 1 mm) of zirconium oxide were added thereto. The mixture was dispersed using a vibrating ball mill (BO type, Chuo Kakoki) for 2 hours.

After dispersion, the contents were taken out, and 8.0 g of a 12.5% solution of gelatin was added thereto. The beads were removed by filtration to obtain a solid dispersion of a dye.

Dye D-1:

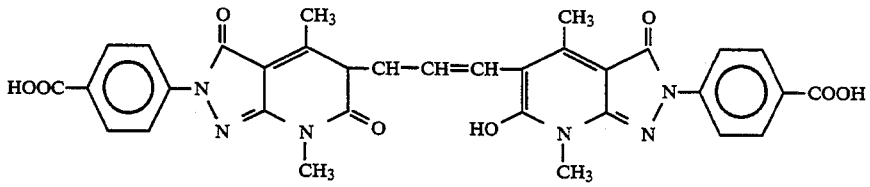

Compositions of these layers were as follows. As a color mixing inhibitor and solvents, the ones used in Example 1 were employed. Further, gelatin from which calcium was removed to 10 ppm or less was used in these layers.

| | |
|---|---|
| Coloring Material-Containing Layer A | |
| Black Colloidal Silver (amount applied, converted to silver) | 0.10 g/m$^2$ |
| Gelatin | 0.99 g/m$^2$ |
| Color Mixing Inhibitor (Cpd-4) | 0.08 g/m$^2$ |
| Solvent (Solv-1) | 0.16 g/m$^2$ |
| Solvent (Solv-4) | 0.08 g/m$^2$ |
| Coloring Material-Containing Layer B | |
| Dye D-1 | 0.06 g/m$^2$ |
| Gelatin | 0.66 g/m$^2$ |
| Intermediate Layer | |
| Gelatin | 0.99 g/m$^2$ |
| Color Mixing Inhibitor (Cpd-4) | 0.08 g/m$^2$ |
| Solvent (Solv-1) | 0 16 g/m$^2$ |
| Solvent (Solv-4) | 0.08 g/m$^2$ |

For the color photographic paper samples thus obtained, the sample provided with coloring material-containing layer A and the intermediate layer was named sample 201, and the sample provided with coloring material-containing layer B and the intermediate layer was named sample 202.

Then, coloring material-containing layer A and the intermediate layer were formed between the titanium oxide-containing hydrophilic colloidal layer and the first layer of sample 112 prepared in Example 1. The resulting sample was named sample 203. Further, coloring material-containing layer B and the intermediate layer were formed therebetween. This sample was named sample 204.

The total amount of calcium contained in the photographic layers constituting each of these samples was 16 mg/m$^2$. Samples each having a calcium content of 8 mg/m$^2$ and a calcium content of 2 mg/m$^2$ were prepared for each of the above-described samples by controlling the calcium content of gelatin used in the photographic constituting layers similarly with Example 1, and represented by attachment of the suffixes "a" and "b" as with Example 1.

Using the resulting color photographic paper samples, tests were carried out similarly with Example 1. Results are summarized in Table 3.

TABLE 3

| Sample | $TiO_2$ Content in Coating Resin (wt %) | $TiO_2$—Containing Hydrophilic Colloidal Layer (Amount of $TiO_2$) ($g/m^2$) | Coloring Material-Containing Layer | Time Reaching Maximum Developed Color Density (sec) | Sharpness (CTF Value) | Pressure Fogging Value: Ca Content ($mg/m^2$) | Pressure Fogging Value: Change in B Density | Remark |
|---|---|---|---|---|---|---|---|---|
| 106 | 50 | Not contained | Not containd | 30 | 19.9 | 16 | +0.05 | Comparison |
| 106a | " | " | " | | | 8 | +0.02 | Invention |
| 106b | " | " | " | | | 2 | +0.02 | Invention |
| 201 | 50 | Not contained | Contained A (colloidal silver) | 32 | 24.2 | 16 | +0.07 | Comparison |
| 201a | " | " | Contained A (colloidal silver) | | | 8 | +0.03 | Invention |
| 201b | " | " | Contained A (colloidal silver) | | | 2 | +0.02 | Invention |
| 202 | 50 | Not contained | Contained B (solid dispersed dye) | 31 | 26.3 | 16 | +0.06 | Comparison |
| 202a | " | " | Contained B (solid dispersed dye) | | | 8 | +0.03 | Invention |
| 202b | " | " | Contained B (solid dispersed dye) | | | 2 | +0.02 | Invention |
| 112 | 13 | Contained(8.0) | Not contained | 29 | 25.7 | 16 | +0.09 | Comparison |
| 112a | " | " | " | | | 8 | +0.03 | Invention |
| 112b | " | " | " | | | 2 | +0.03 | Invention |
| 203 | 13 | Contained(8.0) | Contained A (colloidal silver) | 31 | 26.2 | 16 | +0.10 | Comparison |
| 203a | " | " | Contained A (colloidal silver) | | | 8 | +0.05 | Invention |
| 203b | " | " | Contained A (colloidal silver) | | | 2 | +0.04 | Invention |
| 204 | 13 | Contained(8.0) | Contained B (solid dispersed dye) | 31 | 26.2 | 16 | +0.11 | Comparison |
| 204a | " | " | Contained B (solid dispersed dye) | | | 8 | +0.06 | Invention |
| 204b | " | " | Contained B (solid dispersed dye) | | | 2 | +0.04 | Invention |

As is apparent from the results, the sharpness can be more improved by increasing the content of titanium dioxide in the resin covering the side of the support on which the emulsion layer is applied or by further forming the coloring material-containing layer discolorable with processing on the photographic material provided with a gelatin layer in which titanium dioxide is dispersed at high density. However, such means increasingly promote the development of fogging when the photographic material is bent. According to the present invention, this problem can be effectively solved by reducing the calcium content in the photographic material to 10 $mg/m^2$ or less.

EXAMPLE 3

The photographic constituting layers of the multilayer color photographic paper samples prepared in Examples 1 and 2 were changed to the following layers, thereby preparing new photographic materials and testing the effects of the present invention.

Preparation of Coating Solution for First Layer 133.5 g of yellow coupler (ExY2), 50.0 g of color image stabilizer (Cpd-16), 178.1 g of color image stabilizer (Cpd-17) and color antifoggant (Cpd-4) were dissolved in 50 g of solvent (Solv-8) and 180 ml of ethyl acetate. The resulting solution was emulsified and dispersed in 1000 g of a 10% aqueous solution of gelatin containing 60 ml of 10% sodium dodecylbenzenesulfonate to prepare emulsified dispersion B.

On the other hand, silver chlorobromide emulsion B (cubic, a 3:7 mixture (silver molar ratio) of a large-sized emulsion having a mean grain size of 0.88 μm and a small-sized emulsion having a mean grain size of 0.70 μm, coefficients of variation in grain size distribution for the respective emulsions being 0.07 and 0.08, each emulsion being silver chlorobromide containing 0.5 mol % of silver bromide) was prepared in a manner similar to that used for preparing the emulsions used in the respective layers in Example 1. Chemical sensitization and spectral sensitization of silver chlorobromide emulsion B were conducted for each sized emulsion, independently, prior to mixing. As spectrally sensitizing agents, each of blue-sensitizing dyes B-3 and B-4 shown below were added in an amount of $2.0\times10^{-4}$ mol per mol of silver halide for the large-sized emulsion, and in an amount of $2.5\times10^{-4}$ mol per mol of silver halide for the small-sized emulsion. These emulsions were chemically sensitized so as to optimize the respective sized emulsions by adding sodium thiosulfate and chloroauric acid. The above-described emulsified dispersion B was mixed with the resulting silver chlorobromide emulsion B, and gelatin was added thereto to prepare a coating solution for a first layer so as to give the composition shown below.

Coating solutions for second to seventh layers were also prepared similarly with the coating solution for the first layer. As a gelatin hardener for each layer, the sodium salt of 1-oxy-3,5-dichloro-s-triazine was used.

Cpd-14 and Cpd-15 were added to each layer to total amounts of 25 mg/m$^2$ and 50 mg/m$^2$, respectively.

In silver chlorobromide emulsions of the respective light-sensitive emulsion layers, the following spectrally sensitizing dyes were used.

Sensitizing Dye for Blue-Sensitive Emulsion Layer
Spectrally Sensitizing Dye B-3

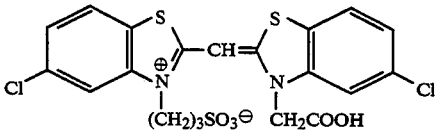

Spectrally Sensitizing Dye B-4

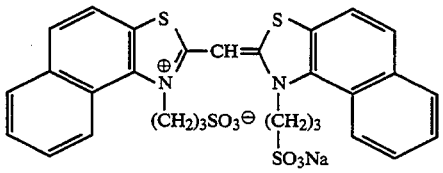

Sensitizing Dye for Green-Sensitive Emulsion Layer
Spectrally Sensitizing Agent G-3

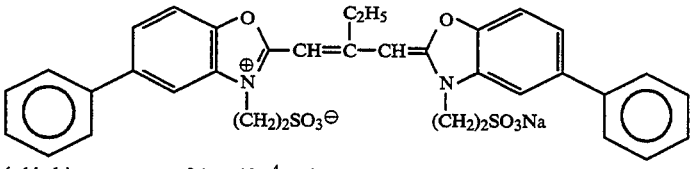

(added in an amount of 4 × 10$^{-4}$ mol per mol of silver halide for a large-sized emulsion, and in an amount of 5.6 × 10$^{-4}$ mol per mol of silver halide for a small-sized emulsion)

Sensitizing Dye for Red-Sensitive Emulsion Layer
Spectrally Sensitizing Agent R-3

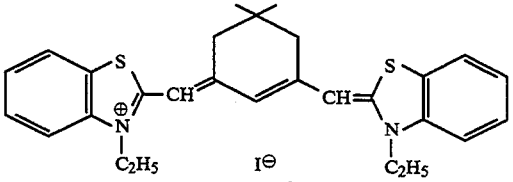

(added in an amount of 1.6 × 10$^{-5}$ mol per mol of silver halide for a large-sized emulsion, and in an amount of 2.0 × 10$^{-5}$ mol per mol of silver halide for a small-sized emulsion)

Further, a 1:1 mixture (molar ratio) of 1-(3-acetamidophenyl)-5-mercaptotetrazole and 1-(5-methylureido-phenyl)-5-mercaptotetrazole was added to the blue-sensitive emulsion layer, the green-sensitive emulsion layer and the red-sensitive emulsion layer in amounts of 8×10$^{-5}$ mol, 7.2×10$^{-4}$ mol and 2.5×10$^{-4}$ mol per mol of silver halide, respectively.

Furthermore, 4-hydroxy-6-methyl-1,3,3a,7-tetraazaindene was added to the blue-sensitive emulsion layer and the green-sensitive emulsion layer in amounts of 1×10$^{-4}$ mol and 2×10$^{-4}$ mol per mol of silver halide, respectively.

In addition, the following dyes were added to the emulsion layers for prevention of irradiation (the numerical values in parentheses indicate weights coated):

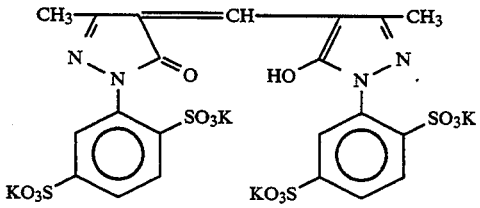

(10 mg/m$^2$)

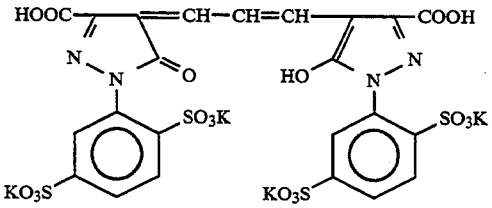

(10 mg/m$^2$)

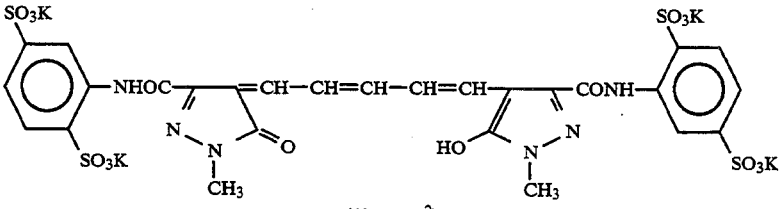

(40 mg/m$^2$)

Support

Various supports were used similarly with Examples 1 and 2 so that the white pigment content of water-resistant resin layer was changed or white pigment-containing hydrophilic colloidal layer was provided.

| | |
|---|---|
| First Layer (Blue-Sensitive Emulsion Layer) | |
| Silver Chlorobromide Emulsion B | 0.26 |
| Gelatin | 1.20 |
| Yellow Coupler (ExY2) | 0.80 |
| Color Image Stabilizer (Cpd-16) | 0.30 |
| Color Image Stabilizer (Cpd-17) | 0.20 |
| Color Antifoggant (Cpd-4) | 0.02 |
| Solvent (Solv-8) | 0.20 |
| Second Layer (Color Mixing Preventing Layer) | |
| Gelatin | 1.25 |
| Color Mixing Stabilizer (Cpd-18) | 0.03 |
| Color Mixing Stabilizer (Cpd-19) | 0.03 |
| Color Mixing Stabilizer (Cpd-20) | 0.03 |
| Color Mixing Stabilizer (Cpd-21) | 0.23 |
| Solvent (Solv-9) | 0.06 |
| Third Layer (Green-Sensitive Emulsion Layer) | |
| Silver Chlorobromide Emulsion (cubic, a 3:7 mixture (silver molar ratio) of a large-sized emulsion having a mean grain size of 0.55 μm and a small-sized emulsion having a mean grain size of 0.39 μm, coefficients of variation in grain size distribution for the respective emulsions being 0.08 and 0.09, each emulsion being silver chlorobromide containing 0.5 mol % of silver bromide) | 0.14 |
| Gelatin | 1.40 |
| Magenta Coupler (ExM2) | 0.24 |
| Color Image Stabilizer (Cpd-22) | 0.24 |
| Color Image Stabilizer (Cpd-23) | 0.21 |
| Solvent (Solv-9) | 0.17 |
| Fourth Layer (Ultraviolet Light Absorbing Layer) | |
| Gelatin | 0.94 |
| Ultraviolet Light Absorber (UV-3) | 0.75 |
| Color Mixing Inhibitor (Cpd-20) | 0.10 |
| Solvent (Solv-8) | 0.40 |
| Fifth Layer (Red-Sensitive Emulsion Layer) | |
| Silver Chlorobromide Emulsion (cubic, a 4:6 mixture (silver molar ratio) of a large-sized emulsion having a mean grain size of 0.52 μm and a small-sized emulsion having a mean grain size of 0.41 μm, coefficients of variation in grain size distribution for the respective emulsions being 0.08 and 0.09, each emulsion being silver chlorobromide containing 0.5 mol % of silver bromide) | 0.22 |
| Gelatin | 1.30 |
| Cyan Coupler (ExC2) | 0.40 |
| Color Image Stabilizer (Cpd-16) | 0.20 |
| Color Antifoggant (Cpd-4) | 0.01 |
| Solvent (Solv-10) | 0.20 |
| Solvent (Solv-11) | 0.20 |
| Sixth Layer (Ultraviolet Light Absorbing Layer) | |
| Gelatin | 0.94 |
| Ultraviolet Light Absorber (UV-3) | 0.75 |
| Color Mixing Inhibitor (Cpd-20) | 0.10 |
| Color Antifoggant (Cpd-24) | 0.03 |
| Solvent (Solv-8) | 0.40 |
| Seventh Layer (Ultraviolet Light Absorbing Layer) | |
| Gelatin | 1.00 |

(ExY2) Yellow Coupler:

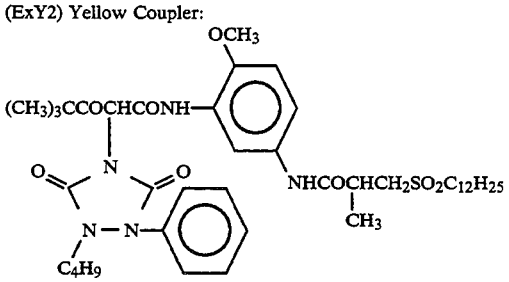

(ExM2) Magenta Coupler:

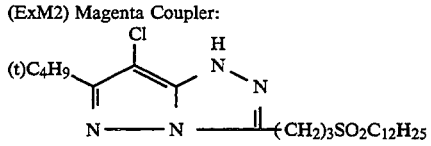

(ExC2) Cyan Coupler: A 7:2 mixture (molar ratio) of

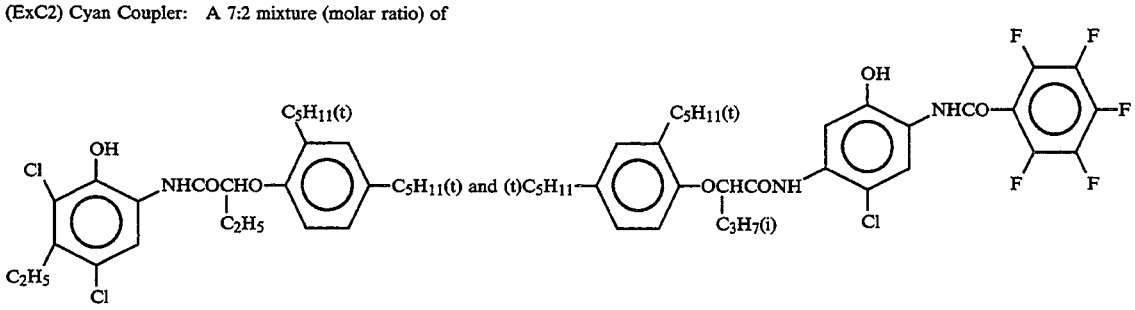

-continued
(Cpd-16) Color Image Stabilizer:
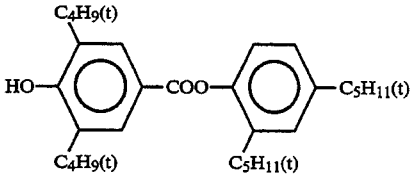
(Cpd-17) Color Image Stabilizer:
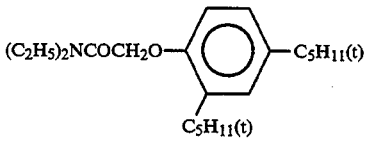
(Cpd-18) Color Mixing Inhibitor:
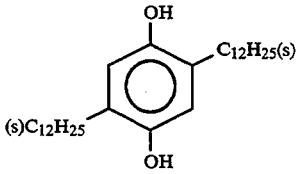
(Cpd-19) Color Mixing Inhibitor:
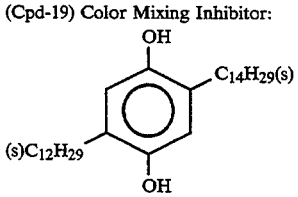
(Cpd-20) Color Mixing Inhibitor:
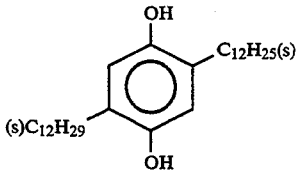
(Cpd-21) Color Mixing Inhibitor:
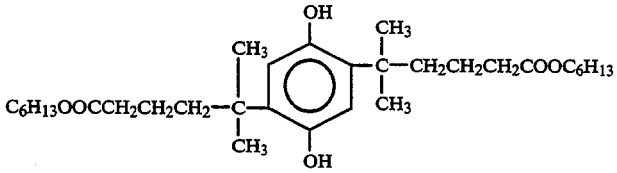
(Cpd-22) Color Image Stabilizer:
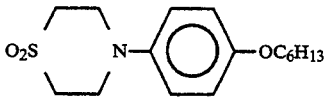
(Cpd-23) Color Image Stabilizer:
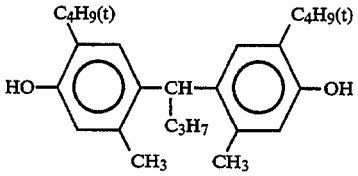
(Cpd-24) Antifoggant:
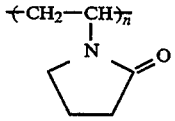
UV-3 A 1:1:2 mixture (molar ratio) of
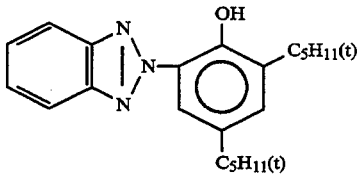
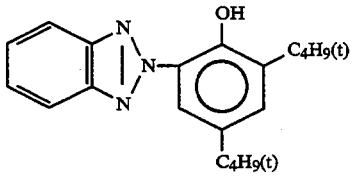
and
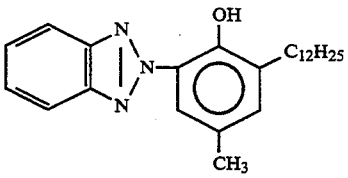
(Solv-8) Solvent:
(Solv-9) Solvent: A 1:1 mixture (weight ratio) of -continued

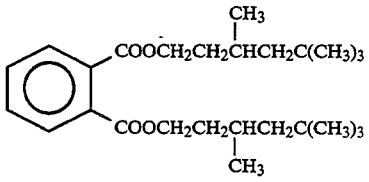

(Solv-10) Solvent:

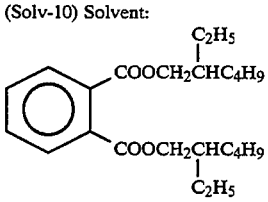

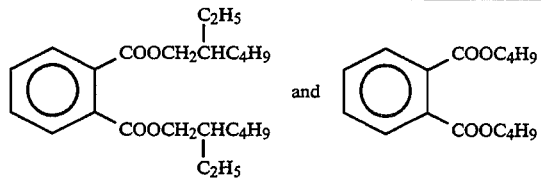

(Solv-11) Solvent:

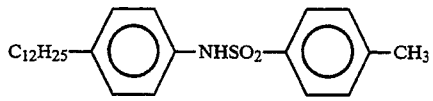

Also in these multilayer color photographic paper samples, the effects of the present invention were confirmed. Namely, the increased content of titanium dioxide in the resin covering the emulsion coating side of the support, said resin being a means for enhancing sharpness, and formation of the gelatin layer with titanium dioxide dispersed therein at high density very much increase the development of fogging when the photographic material is bent. To such problems, the development of fogging could be effectively inhibited by reducing the calcium content in the photographic material to 10 mg/m$^2$ or less.

The silver halide photographic materials of the present invention having the reflective supports are particularly suitable for light-sensitive materials for photographic paper. The increased content of titanium dioxide in the resin covering the emulsion coating side of the support and formation of the gelatin layer with titanium dioxide dispersed therein at high density enhance the sharpness of images, and further the development of fogging produced when the photographic material is bent can be effectively inhibited. Namely, photographic materials for rapid processing can be provided which give excellent image quality upon processing and which also have excellent handling characteristics.

While the invention has been described in detail and with reference to specific embodiments thereof, it will be apparent to one skilled in the art that various changes and modifications can be made therein without departing from the spirit and scope thereof.

What is claimed is:

1. A color photographic material having photographic constituent layers including at least one light-sensitive silver halide emulsion layer on a reflective support, wherein the light-sensitive silver halide emulsion layer comprises silver chloride or silver chlorobromide containing 90 mol % or more of silver chloride and further comprises a pyrazolotriazole magenta coupler in which a secondary or tertiary alkyl group is directly bonded to the 2-, 3- or 6- position of a pyrazolotriazole ring, said reflective support comprises at least one water-resistant resin layer, the water-resistant resin layer on the side of the support on which a silver halide emulsion layer is formed contains 14% by weight or more of a white pigment, and the total amount of calcium contained in the photographic constituent layers on the light-sensitive layer side of the photographic material is 10 mg/m$^2$ or less.

2. The color photographic material of claim 1, wherein said water-resistant resin layer contains 15% by weight or more of the white pigment.

3. The color photographic material of claim 2, further comprising a coloring layer discolorable with processing at any position among the group of hydrophilic colloidal layers formed on the light-sensitive layer side of said support.

4. The color photographic material of claim 2, wherein the total amount of calcium is 8 mg/m$^2$ or less.

5. The color photographic material of claim 2, wherein the total amount of calcium is 5 mg/m$^2$ or less.

6. The color photographic material of claim 2, wherein the total amount of calcium is 2 mg/m$^2$ or less.

7. The color photographic material of claim 3, wherein the coloring layer contains a finely divided dye or colloidal silver as a light-absorbing agent.

8. A color photographic material having photographic constituent layers including at least one light-sensitive silver halide emulsion layer and hydrophilic colloidal layers on a support, wherein the light-sensitive silver halide emulsion layer comprises silver chloride or silver chlorobromide containing 90 mol % or more of silver chloride and further comprises a pyrazolotriazole magenta coupler in which a secondary or tertiary alkyl group is directly bonded to the 2-, 3- or 6- position of a pyrazolotriazole ring, at least one of said hydrophilic colloidal layers contains a white pigment at a coating amount of 2 g/m$^2$ or more, and the total amount of calcium contained in the photographic constituent layers on the light-sensitive layer side of the photographic material is 10 mg/m$^2$ or less.

9. The color photographic material of claim 8, further comprising a coloring layer discolorable with processing at any position among the group of hydrophilic colloidal layers formed on the light-sensitive layer side of said support.

10. A color photographic material having photographic constituent layers including at least one light-sensitive silver halide emulsion layer and hydrophilic colloidal layers on a reflective support, wherein the light-sensitive silver halide emulsion layer comprises silver chloride or silver chlorobromide containing 90 mol % or more of silver chloride and further comprises a pyrazolotriazole magenta coupler in which a secondary or tertiary alkyl group is directly bonded to the 2-, 3- or 6- position of a pyrazolotriazole ring, at least one of said hydrophilic colloidal layers contains a white pigment at a density of 20% by weight or more, and the total amount of calcium contained in the photographic constituent layers on the light-sensitive layer side of the photographic material is 10 mg/m$^2$ or less.

11. The color photographic material of claim 10, further comprising a coloring layer discolorable with processing at any position among the group of hydrophilic colloidal layers formed on the light-sensitive layer side of said support.

12. The color photographic material of claim 10, wherein the total amount of calcium is 8 mg/m$^2$ or less.

13. The color photographic material of claim 10, wherein the total amount of calcium is 5 mg/m$^2$ or less.

14. The color photographic material of claim 10, wherein the total amount of calcium is 2 mg/m$^2$ or less.

15. The color photographic material of claim 11, wherein the coloring layer contains a finely divided dye or colloidal silver as a light-absorbing agent.

* * * * *